US007929723B2

(12) United States Patent
Hagen et al.

(10) Patent No.: US 7,929,723 B2
(45) **Date of Patent: *Apr. 19, 2011**

(54) PORTABLE SYSTEM FOR PROGRAMMING HEARING AIDS

(75) Inventors: Lawrence T. Hagen, Minnetonka, MN (US); David A. Preves, Chanhassen, MN (US); James Newton, Burnsville, MN (US); Garry Richardson, Colorado Springs, CO (US)

(73) Assignee: Micro Ear Technology, Inc., Plymouth, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/553,857

(22) Filed: Sep. 3, 2009

(65) Prior Publication Data

US 2010/0086153 A1 Apr. 8, 2010

Related U.S. Application Data

(63) Continuation of application No. 10/842,246, filed on May 10, 2004, now Pat. No. 7,787,647, which is a continuation-in-part of application No. 10/096,335, filed on Mar. 11, 2002, now Pat. No. 6,888,948, which is a continuation of application No. 08/896,484, filed on Jul. 18, 1997, now Pat. No. 6,424,722, which is a continuation-in-part of application No. 08/782,328, filed on Jan. 13, 1997, now abandoned.

(51) Int. Cl.
*H04R 25/00* (2006.01)

(52) U.S. Cl. ..... 381/314; 381/322

(58) Field of Classification Search ..... 381/60, 381/312, 314, 315, 322, 323, 306, 388; 710/300–302, 69, 8–14, 72–73; 700/94
See application file for complete search history.

(56) References Cited

U.S. PATENT DOCUMENTS

| | | | |
|---|---|---|---|
| 3,527,901 | A | 9/1970 | Geib |
| 4,188,667 | A | 2/1980 | Graupe et al. |
| 4,366,349 | A | 12/1982 | Adelman |
| 4,396,806 | A | 8/1983 | Anderson |

(Continued)

FOREIGN PATENT DOCUMENTS

| | | |
|---|---|---|
| DE | 4339898 | 11/1993 |

(Continued)

OTHER PUBLICATIONS

"U.S. Appl. No. 08/782,328, Non Final Office Action mailed Jul. 7, 1998", 7 pgs.

(Continued)

*Primary Examiner* — Fan Tsang
*Assistant Examiner* — Phylesha Dabney
(74) *Attorney, Agent, or Firm* — Schwegmann, Lundberg & Woessner, P.A.

(57) ABSTRACT

A system for programming one or more hearing aids with a host computer, the system including a hearing aid programmer for wireless communications with the host computer. In various embodiments, the hearing aid programmer has at least one interface connector for communication with at least one hearing aid. Additionally, in various embodiments, the system includes a wireless interface adapted for connecting to the at least one interface connector of the hearing aid programmer, the wireless interface further adapted for wireless communication with one or more hearing aids. Varying embodiments of the present subject matter include a wireless interface which contains signal processing electronics, a memory connected to the signal processing electronics; and a wireless module connected to the signal processing electronics and adapted for wireless communications.

20 Claims, 15 Drawing Sheets

U.S. PATENT DOCUMENTS

| | | | |
|---|---|---|---|
| 4,419,544 | A | 12/1983 | Adelman |
| 4,425,481 | A | 1/1984 | Mansgold et al. |
| 4,471,490 | A | 9/1984 | Bellafiore |
| 4,548,082 | A | 10/1985 | Engebretson et al. |
| 4,606,329 | A | 8/1986 | Hough |
| 4,617,429 | A | 10/1986 | Bellafiore |
| 4,628,907 | A | 12/1986 | Epley |
| 4,634,815 | A | 1/1987 | Marquis |
| 4,636,876 | A | 1/1987 | Schwartz |
| 4,637,402 | A | 1/1987 | Adelman |
| 4,652,702 | A | 3/1987 | Yoshii |
| 4,657,106 | A | 4/1987 | Hardt |
| 4,680,799 | A | 7/1987 | Henneberger |
| 4,682,248 | A | 7/1987 | Schwartz |
| 4,689,820 | A | 8/1987 | Kopke et al. |
| 4,706,778 | A | 11/1987 | Topholm |
| 4,712,245 | A | 12/1987 | Lyregaard |
| 4,731,850 | A | 3/1988 | Levitt et al. |
| 4,735,759 | A | 4/1988 | Bellafiore |
| 4,755,889 | A | 7/1988 | Schwartz |
| 4,756,312 | A | 7/1988 | Epley |
| 4,763,752 | A | 8/1988 | Haertl et al. |
| 4,776,322 | A | 10/1988 | Hough et al. |
| 4,791,672 | A | 12/1988 | Nunley et al. |
| 4,800,982 | A | 1/1989 | Carlson |
| 4,811,402 | A | 3/1989 | Ward |
| 4,815,138 | A | 3/1989 | Dietelm |
| 4,817,609 | A | 4/1989 | Perkins et al. |
| 4,834,211 | A | 5/1989 | Bibby et al. |
| 4,867,267 | A | 9/1989 | Carlson |
| 4,869,339 | A | 9/1989 | Barton |
| 4,870,688 | A | 9/1989 | Voroba et al. |
| 4,870,689 | A | 9/1989 | Weiss |
| 4,879,749 | A | 11/1989 | Levitt et al. |
| 4,879,750 | A | 11/1989 | Nassler |
| 4,880,076 | A | 11/1989 | Ahlberg et al. |
| 4,882,762 | A | 11/1989 | Waldhauer |
| 4,887,299 | A | 12/1989 | Cummins et al. |
| 4,920,570 | A | 4/1990 | West et al. |
| 4,937,876 | A | 6/1990 | Biermans |
| 4,947,432 | A | 8/1990 | Topholm |
| 4,953,215 | A | 8/1990 | Weiss et al. |
| 4,961,230 | A | 10/1990 | Rising |
| 4,962,537 | A | 10/1990 | Basel et al. |
| 4,966,160 | A | 10/1990 | Birck et al. |
| 4,972,487 | A | 11/1990 | Mangold et al. |
| 4,972,488 | A | 11/1990 | Weiss et al. |
| 4,972,492 | A | 11/1990 | Tanaka et al. |
| 4,975,967 | A | 12/1990 | Rasmussen |
| 4,977,976 | A | 12/1990 | Major |
| 4,989,251 | A | 1/1991 | Mangold |
| 5,002,151 | A | 3/1991 | Oliveira et al. |
| 5,003,607 | A | 3/1991 | Reed |
| 5,003,608 | A | 3/1991 | Carlson |
| 5,008,943 | A | 4/1991 | Arndt et al. |
| 5,012,520 | A | 4/1991 | Steeger |
| 5,014,016 | A | 5/1991 | Anderson |
| 5,016,280 | A | 5/1991 | Engebretson et al. |
| 5,027,410 | A | 6/1991 | Williamson et al. |
| 5,033,090 | A | 7/1991 | Weinrich |
| 5,044,373 | A | 9/1991 | Northeved et al. |
| 5,046,580 | A | 9/1991 | Barton |
| 5,048,077 | A | 9/1991 | Wells et al. |
| 5,048,092 | A | 9/1991 | Yamagishi et al. |
| 5,061,845 | A | 10/1991 | Pinnavaia |
| 5,068,902 | A | 11/1991 | Ward |
| 5,083,312 | A | 1/1992 | Newton et al. |
| 5,101,435 | A | 3/1992 | Carlson |
| 5,111,419 | A | 5/1992 | Morley, Jr. et al. |
| 5,133,016 | A | 7/1992 | Clark |
| 5,142,587 | A | 8/1992 | Kobayashi |
| 5,144,674 | A | 9/1992 | Meyer et al. |
| 5,146,051 | A | 9/1992 | Hermann |
| 5,166,659 | A | 11/1992 | Navarro |
| 5,185,802 | A | 2/1993 | Stanton |
| 5,195,139 | A | 3/1993 | Gauthier |
| 5,197,332 | A | 3/1993 | Shennib |
| 5,201,007 | A | 4/1993 | Ward et al. |
| 5,202,927 | A | 4/1993 | Topholm |
| 5,208,867 | A | 5/1993 | Stites, III |
| 5,210,803 | A | 5/1993 | Raimund et al. |
| 5,220,612 | A | 6/1993 | Tibbetts et al. |
| 5,222,151 | A | 6/1993 | Nagayoshi et al. |
| 5,225,836 | A | 7/1993 | Morley, Jr. et al. |
| 5,226,086 | A | 7/1993 | Platt |
| 5,257,315 | A | 10/1993 | Haertl et al. |
| 5,259,032 | A | 11/1993 | Perkins et al. |
| 5,276,739 | A | 1/1994 | Krokstad et al. |
| 5,277,694 | A | 1/1994 | Leysieffer et al. |
| 5,282,253 | A | 1/1994 | Konomi |
| 5,295,191 | A | 3/1994 | Van Vroenhoven |
| 5,298,692 | A | 3/1994 | Ikeda et al. |
| 5,303,305 | A | 4/1994 | Raimo et al. |
| 5,303,306 | A | 4/1994 | Brillhart et al. |
| 5,319,163 | A | 6/1994 | Scott |
| 5,321,757 | A | 6/1994 | Woodfill, Jr. |
| 5,327,500 | A | 7/1994 | Campbell |
| 5,338,287 | A | 8/1994 | Miller et al. |
| 5,343,319 | A | 8/1994 | Moore |
| 5,345,509 | A | 9/1994 | Hofer et al. |
| 5,347,477 | A | 9/1994 | Lee |
| 5,357,251 | A | 10/1994 | Morley, Jr. et al. |
| 5,357,576 | A | 10/1994 | Arndt |
| 5,363,444 | A | 11/1994 | Norris |
| 5,365,593 | A | 11/1994 | Greenwood et al. |
| 5,373,149 | A | 12/1994 | Rasmussen |
| 5,373,555 | A | 12/1994 | Norris et al. |
| 5,381,484 | A | 1/1995 | Claes et al. |
| 5,384,852 | A | 1/1995 | Scharen |
| 5,387,875 | A | 2/1995 | Tateno |
| 5,388,248 | A | 2/1995 | Robinson et al. |
| 5,390,254 | A | 2/1995 | Adelman |
| 5,395,168 | A | 3/1995 | Leenen |
| 5,402,494 | A | 3/1995 | Flippe et al. |
| 5,402,496 | A | 3/1995 | Soli et al. |
| 5,404,407 | A | 4/1995 | Weiss |
| 5,406,619 | A | 4/1995 | Akhteruzzaman et al. |
| 5,416,847 | A | 5/1995 | Boze |
| 5,418,524 | A | 5/1995 | Fennell |
| 5,420,930 | A | 5/1995 | Shugart, III |
| 5,422,855 | A | 6/1995 | Eslick et al. |
| 5,425,104 | A | 6/1995 | Shennib |
| 5,434,924 | A | 7/1995 | Jampolsky |
| 5,440,449 | A | 8/1995 | Scheer |
| 5,445,525 | A | 8/1995 | Broadbent et al. |
| 5,448,637 | A | 9/1995 | Yamaguchi et al. |
| 5,475,759 | A | 12/1995 | Engebretson |
| 5,479,522 | A | 12/1995 | Lindemann et al. |
| 5,481,616 | A | 1/1996 | Freadman |
| 5,487,161 | A | 1/1996 | Koenck et al. |
| 5,488,668 | A | 1/1996 | Waldhauer |
| 5,500,901 | A | 3/1996 | Geraci et al. |
| 5,500,902 | A | 3/1996 | Stockham, Jr. et al. |
| 5,502,769 | A | 3/1996 | Gilbertson |
| 5,515,424 | A | 5/1996 | Kenney |
| 5,515,443 | A | 5/1996 | Meyer |
| 5,530,763 | A | 6/1996 | Aebi et al. |
| 5,531,787 | A | 7/1996 | Lesinski et al. |
| 5,533,029 | A | 7/1996 | Gardner |
| 5,535,282 | A | 7/1996 | Luca |
| 5,540,597 | A | 7/1996 | Budman et al. |
| 5,544,222 | A | 8/1996 | Robinson et al. |
| 5,546,590 | A | 8/1996 | Pierce |
| 5,553,151 | A | 9/1996 | Goldberg |
| 5,553,152 | A | 9/1996 | Newton |
| 5,555,490 | A | 9/1996 | Carroll |
| 5,559,501 | A | 9/1996 | Barzegar et al. |
| 5,561,446 | A | 10/1996 | Montlick |
| 5,563,400 | A | 10/1996 | Le Roux |
| 5,572,594 | A | 11/1996 | Devoe et al. |
| 5,572,683 | A | 11/1996 | Epolite et al. |
| 5,574,654 | A | 11/1996 | Bingham et al. |
| 5,581,747 | A | 12/1996 | Anderson |
| 5,590,373 | A | 12/1996 | Whitley et al. |
| 5,602,925 | A | 2/1997 | Killion |
| 5,603,096 | A | 2/1997 | Gilhousen et al. |
| 5,604,812 | A | 2/1997 | Meyer |

5,606,620 A 2/1997 Weinfurtner
5,606,621 A 2/1997 Reiter et al.
5,615,344 A 3/1997 Corder
5,619,396 A 4/1997 Gee et al.
5,626,629 A 5/1997 Faltys et al.
5,640,490 A 6/1997 Hansen et al.
5,645,074 A 7/1997 Shennib et al.
5,649,001 A 7/1997 Thomas et al.
5,659,621 A 8/1997 Newton
5,664,228 A 9/1997 Mital
5,666,125 A 9/1997 Luxon et al.
5,671,368 A 9/1997 Chan et al.
5,677,948 A 10/1997 Meister
5,696,970 A 12/1997 Sandage et al.
5,696,993 A 12/1997 Gavish
5,708,720 A 1/1998 Meyer
5,710,819 A 1/1998 Topholm et al.
5,710,820 A 1/1998 Martin et al.
5,717,771 A 2/1998 Sauer et al.
5,717,818 A 2/1998 Nejime et al.
5,721,783 A 2/1998 Anderson
5,736,727 A 4/1998 Nakata et al.
5,737,706 A 4/1998 Seazholtz et al.
5,738,633 A 4/1998 Christiansen
5,740,165 A 4/1998 Vannucci
5,751,820 A 5/1998 Taenzer
5,757,933 A 5/1998 Preves et al.
5,784,602 A 7/1998 Glass et al.
5,784,628 A 7/1998 Reneris
5,785,661 A 7/1998 Shennib
5,794,201 A 8/1998 Nejime et al.
5,800,473 A 9/1998 Faisandier
5,809,017 A 9/1998 Smith et al.
5,812,936 A 9/1998 DeMont
5,812,938 A 9/1998 Gilhousen et al.
5,814,095 A 9/1998 Muller et al.
5,819,162 A 10/1998 Spann et al.
5,822,442 A 10/1998 Agnew et al.
5,824,022 A 10/1998 Zilberman et al.
5,825,631 A 10/1998 Prchal
5,825,894 A 10/1998 Shennib
5,827,179 A 10/1998 Lichter et al.
5,835,611 A 11/1998 Kaiser et al.
5,842,115 A 11/1998 Dent
5,845,251 A 12/1998 Case
5,852,668 A 12/1998 Ishige et al.
5,861,968 A 1/1999 Kerklaan et al.
5,862,238 A 1/1999 Agnew et al.
5,864,708 A 1/1999 Croft et al.
5,864,813 A 1/1999 Case
5,864,820 A 1/1999 Case
5,870,481 A 2/1999 Dymond et al.
5,878,282 A 3/1999 Mital
5,883,927 A 3/1999 Madsen et al.
5,884,260 A 3/1999 Leonhard
5,887,067 A 3/1999 Costa et al.
5,890,016 A 3/1999 Tso
5,909,497 A 6/1999 Alexandrescu
5,910,997 A 6/1999 Ishige et al.
5,915,031 A 6/1999 Hanright
5,916,174 A 6/1999 Dolphin
5,917,812 A 6/1999 Antonio et al.
5,923,764 A 7/1999 Shennib
5,926,388 A 7/1999 Kimbrough et al.
5,926,500 A 7/1999 Odenwalder
5,929,848 A 7/1999 Albukerk et al.
5,930,230 A 7/1999 Odenwalder et al.
5,956,330 A 9/1999 Kerns
5,960,346 A 9/1999 Holshouser
5,987,513 A 11/1999 Prithviraj et al.
6,002,776 A 12/1999 Bhadkamkar et al.
6,009,311 A 12/1999 Killion et al.
6,009,480 A 12/1999 Pleso
6,016,115 A 1/2000 Heubi
6,016,962 A 1/2000 Nakata et al.
6,021,207 A 2/2000 Puthuff et al.
6,022,315 A 2/2000 Iliff
6,023,570 A 2/2000 Tang et al.
6,032,866 A 3/2000 Knighton et al.
6,035,050 A 3/2000 Weinfurtner et al.
6,041,046 A 3/2000 Scott et al.
6,041,129 A 3/2000 Adelman
6,048,305 A 4/2000 Bauman et al.
6,058,197 A 5/2000 Delage
6,061,431 A 5/2000 Knappe et al.
6,078,675 A 6/2000 Bowen-Nielsen et al.
6,081,629 A 6/2000 Browning
6,084,972 A 7/2000 van Halteren et al.
6,088,339 A 7/2000 Meyer
6,088,465 A 7/2000 Hanright et al.
6,094,492 A 7/2000 Boesen
6,095,820 A 8/2000 Luxon et al.
6,104,822 A 8/2000 Melanson et al.
6,104,913 A 8/2000 McAllister
6,112,103 A 8/2000 Puthuff
6,115,478 A 9/2000 Schneider
6,118,877 A 9/2000 Lindemann et al.
6,118,882 A 9/2000 Haynes
6,122,500 A 9/2000 Dent et al.
6,137,889 A 10/2000 Shennib et al.
6,144,748 A 11/2000 Kerns
6,149,605 A 11/2000 Christiansen
6,151,645 A 11/2000 Young et al.
6,157,727 A 12/2000 Rueda
6,167,138 A 12/2000 Shennib
6,181,801 B1 1/2001 Puthuff et al.
6,188,979 B1 2/2001 Ashley
6,198,971 B1 3/2001 Leysieffer
6,201,875 B1 3/2001 Davis et al.
6,205,190 B1 3/2001 Antonio
6,219,427 B1 4/2001 Kates et al.
6,229,900 B1 5/2001 Leenen
6,236,731 B1 5/2001 Brennan et al.
6,240,192 B1 5/2001 Brennan et al.
6,240,193 B1 5/2001 Green
6,240,194 B1 5/2001 De Koning
6,251,062 B1 6/2001 Leysieffer
6,265,102 B1 7/2001 Shrim et al.
6,308,222 B1 10/2001 Krueger et al.
6,317,613 B1 11/2001 Brown, Jr.
6,320,969 B1 11/2001 Killion
6,323,980 B1 11/2001 Bloom
6,324,907 B1 12/2001 Halteren et al.
6,330,233 B1 12/2001 Miya et al.
6,334,072 B1 12/2001 Leysieffer
6,336,863 B1 1/2002 Baerlocher et al.
6,347,148 B1 2/2002 Brennan et al.
6,351,472 B1 2/2002 Meyer
6,366,863 B1 4/2002 Bye et al.
6,366,880 B1 4/2002 Ashley
6,377,925 B1 4/2002 Greene, Jr. et al.
6,379,314 B1 4/2002 Horn
6,389,142 B1 5/2002 Hagen et al.
6,422,471 B2 7/2002 Kowalski
6,424,722 B1 7/2002 Hagen et al.
6,438,245 B1 8/2002 Taenzer et al.
6,449,662 B1 9/2002 Armitage
6,453,051 B1 9/2002 Killion
6,466,678 B1 10/2002 Killion et al.
6,490,427 B2 12/2002 Shields
6,490,627 B1 12/2002 Kalra et al.
6,493,453 B1 12/2002 Glendon
6,545,989 B1 4/2003 Butler
6,554,762 B2 4/2003 Leysieffer
6,557,029 B2 4/2003 Szymansky
6,565,503 B2 5/2003 Leysieffer et al.
6,574,342 B1 6/2003 Davis et al.
6,575,894 B2 6/2003 Leysieffer et al.
6,584,356 B2 6/2003 Wassmund et al.
6,590,986 B1 7/2003 Fazio
6,590,987 B2 7/2003 Delage
6,601,093 B1 7/2003 Peters
6,603,860 B1 8/2003 Taenzer et al.
6,606,391 B2 8/2003 Brennan et al.
6,644,120 B1 11/2003 Braun et al.
6,647,345 B2 11/2003 Bye et al.
6,654,652 B1 11/2003 Dalton et al.
6,658,307 B1 12/2003 Mueller

| | | | |
|---|---|---|---|
| 6,674,867 | B2 | 1/2004 | Basseas |
| 6,684,063 | B2 | 1/2004 | Berger et al. |
| 6,695,943 | B2 | 2/2004 | Juneau et al. |
| 6,697,674 | B2 | 2/2004 | Leysieffer |
| 6,704,424 | B2 | 3/2004 | Killion |
| 6,707,581 | B1 | 3/2004 | Browning |
| 6,717,925 | B1 | 4/2004 | Leppisaari et al. |
| 6,738,485 | B1 | 5/2004 | Boesen |
| 6,788,790 | B1 | 9/2004 | Leysieffer |
| 6,792,114 | B1 | 9/2004 | Kates et al. |
| 6,823,312 | B2 | 11/2004 | Mittal et al. |
| 6,850,775 | B1 | 2/2005 | Berg |
| 6,851,048 | B2 | 2/2005 | Armitage et al. |
| 6,882,628 | B2 | 4/2005 | Nakagawa et al. |
| 6,888,948 | B2 | 5/2005 | Hagen et al. |
| 6,895,345 | B2 | 5/2005 | Bye et al. |
| 6,913,578 | B2 | 7/2005 | Hou |
| 6,944,474 | B2 | 9/2005 | Rader et al. |
| 6,974,421 | B1 | 12/2005 | Causevic et al. |
| 6,978,155 | B2 | 12/2005 | Berg |
| 7,016,504 | B1 | 3/2006 | Shennib |
| 7,054,957 | B2 | 5/2006 | Armitage |
| 7,451,256 | B2 | 11/2008 | Hagen et al. |
| 7,787,647 | B2 | 8/2010 | Hagen et al. |
| 2001/0003542 | A1 | 6/2001 | Kita |
| 2001/0004397 | A1 | 6/2001 | Kita et al. |
| 2001/0007050 | A1 | 7/2001 | Adelman |
| 2001/0009019 | A1 | 7/2001 | Armitage et al. |
| 2001/0031996 | A1 | 10/2001 | Leysieffer |
| 2001/0031999 | A1 | 10/2001 | Carter et al. |
| 2001/0033664 | A1 | 10/2001 | Poux et al. |
| 2001/0040873 | A1 | 11/2001 | Nakagawa et al. |
| 2001/0041602 | A1 | 11/2001 | Berger et al. |
| 2001/0044668 | A1 | 11/2001 | Kimbrough et al. |
| 2001/0049466 | A1 | 12/2001 | Leysieffer et al. |
| 2002/0012438 | A1 | 1/2002 | Leysieffer et al. |
| 2002/0015506 | A1 | 2/2002 | Aceti et al. |
| 2002/0026091 | A1 | 2/2002 | Leysieffer |
| 2002/0029070 | A1 | 3/2002 | Leysieffer et al. |
| 2002/0043545 | A1 | 4/2002 | Tang |
| 2002/0048374 | A1 | 4/2002 | Soli et al. |
| 2002/0076073 | A1 | 6/2002 | Taenzer et al. |
| 2002/0083235 | A1 | 6/2002 | Armitage |
| 2002/0094098 | A1 | 7/2002 | Delage |
| 2002/0095292 | A1 | 7/2002 | Mittl et al. |
| 2002/0111745 | A1 | 8/2002 | Bye et al. |
| 2002/0150219 | A1 | 10/2002 | Jorgenson et al. |
| 2002/0165466 | A1 | 11/2002 | Givens et al. |
| 2002/0168075 | A1 | 11/2002 | Hagen et al. |
| 2002/0183648 | A1 | 12/2002 | Hou |
| 2003/0014566 | A1 | 1/2003 | Armitage |
| 2003/0064746 | A1 | 4/2003 | Rader et al. |
| 2003/0128859 | A1 | 7/2003 | Greene et al. |
| 2003/0144603 | A1 | 7/2003 | Zoth et al. |
| 2003/0162529 | A1 | 8/2003 | Noblins |
| 2003/0181201 | A1 | 9/2003 | Bomze et al. |
| 2004/0204921 | A1 | 10/2004 | Bye |
| 2005/0008175 | A1 | 1/2005 | Hagen et al. |
| 2005/0196002 | A1 | 9/2005 | Hagen et al. |
| 2005/0283263 | A1 | 12/2005 | Eaton et al. |
| 2006/0074572 | A1 | 4/2006 | Bye et al. |
| 2008/0137888 | A1 | 6/2008 | Newton et al. |

FOREIGN PATENT DOCUMENTS

| | | | |
|---|---|---|---|
| DE | 19541648 | | 5/1997 |
| DE | 19600234 | | 7/1997 |
| DE | 29905172 | | 7/1999 |
| DE | 19815373 | | 10/1999 |
| DE | 19916900 | | 9/2000 |
| DE | 19949604 | | 5/2001 |
| EP | 0341902 | A2 | 11/1989 |
| EP | 0341903 | A2 | 11/1989 |
| EP | 0342782 | A2 | 11/1989 |
| EP | 0363609 | A1 | 4/1990 |
| EP | 0381608 | A2 | 8/1990 |
| EP | 0448764 | A1 | 10/1991 |
| EP | 0537026 | A2 | 4/1993 |
| EP | 0565279 | A2 | 10/1993 |
| EP | 0579152 | A1 | 1/1994 |
| EP | 0632609 | A2 | 1/1995 |
| EP | 0658035 | A2 | 6/1995 |
| EP | 0689755 | A1 | 1/1996 |
| EP | 0726519 | A1 | 8/1996 |
| EP | 0742548 | A2 | 11/1996 |
| EP | 0763903 | A1 | 3/1997 |
| EP | 0765042 | A2 | 3/1997 |
| EP | 0789474 | A2 | 8/1997 |
| EP | 0796035 | A1 | 9/1997 |
| EP | 0800331 | A2 | 10/1997 |
| EP | 0805562 | A2 | 11/1997 |
| EP | 0823829 | A2 | 2/1998 |
| EP | 0831674 | A2 | 3/1998 |
| EP | 0853443 | A2 | 7/1998 |
| EP | 0858180 | A2 | 8/1998 |
| EP | 0873034 | A2 | 10/1998 |
| EP | 0886389 | A2 | 12/1998 |
| EP | 0895364 | A1 | 2/1999 |
| EP | 0737351 | A1 | 3/1999 |
| EP | 0903871 | A2 | 3/1999 |
| EP | 0910191 | A1 | 4/1999 |
| EP | 0936831 | A1 | 8/1999 |
| EP | 0964603 | A1 | 12/1999 |
| EP | 0876717 | B1 | 4/2000 |
| EP | 1191817 | A1 | 3/2002 |
| EP | 0878928 | B1 | 8/2002 |
| EP | 1596633 | A2 | 11/2005 |
| JP | 1318500 | A | 12/1989 |
| JP | 10210541 | | 8/1998 |
| JP | 11055219 | | 2/1999 |
| JP | 11133998 | | 5/1999 |
| JP | 11196065 | | 7/1999 |
| JP | 2000287299 | | 10/2000 |
| WO | WO-8404195 | A1 | 10/1984 |
| WO | WO-8701851 | A1 | 3/1987 |
| WO | WO-9103042 | A1 | 3/1991 |
| WO | WO-9422372 | A1 | 3/1994 |
| WO | WO-9425958 | A1 | 11/1994 |
| WO | WO-9513685 | A2 | 5/1995 |
| WO | WO-9515712 | A1 | 6/1995 |
| WO | WO-9602097 | A1 | 1/1996 |
| WO | WO-8601671 | A1 | 3/1996 |
| WO | WO-9637086 | A1 | 11/1996 |
| WO | WO-9641498 | A1 | 12/1996 |
| WO | WO-9714266 | A1 | 4/1997 |
| WO | WO-9714267 | A1 | 4/1997 |
| WO | WO-9717819 | A1 | 5/1997 |
| WO | WO-9719573 | A1 | 5/1997 |
| WO | WO-9723062 | A1 | 6/1997 |
| WO | WO-9727682 | A1 | 6/1997 |
| WO | WO-9727712 | A1 | 7/1997 |
| WO | WO-9731431 | A1 | 8/1997 |
| WO | WO-9739537 | A1 | 10/1997 |
| WO | WO-9741653 | A1 | 11/1997 |
| WO | WO-9802969 | A1 | 1/1998 |
| WO | WO-9816086 | A1 | 4/1998 |
| WO | WO-9826513 | A1 | 6/1998 |
| WO | WO-9841030 | A2 | 9/1998 |
| WO | WO-9844648 | A1 | 10/1998 |
| WO | WO-9844667 | A2 | 10/1998 |
| WO | WO-9847313 | A2 | 10/1998 |
| WO | WO-9847314 | A2 | 10/1998 |
| WO | WO-9849785 | A2 | 11/1998 |
| WO | WO-9851124 | A1 | 11/1998 |
| WO | WO-9854928 | A2 | 12/1998 |
| WO | WO-9855833 | A1 | 12/1998 |
| WO | WO-9856106 | A2 | 12/1998 |
| WO | WO-9901994 | A2 | 1/1999 |
| WO | WO-9907302 | A1 | 2/1999 |
| WO | WO-9908457 | A2 | 2/1999 |
| WO | WO-9919779 | A1 | 4/1999 |
| WO | WO-9922550 | A1 | 5/1999 |
| WO | WO-9926392 | A1 | 5/1999 |
| WO | WO-9931935 | A1 | 6/1999 |
| WO | WO-9931937 | A1 | 6/1999 |
| WO | WO-9943105 | A1 | 8/1999 |
| WO | WO-9943185 | A1 | 8/1999 |
| WO | WO-9946912 | A1 | 9/1999 |
| WO | WO-9948330 | A1 | 9/1999 |

| | | | |
|---|---|---|---|
| WO | WO-9951057 | A1 | 10/1999 |
| WO | WO-0002418 | A1 | 1/2000 |
| WO | WO-0010363 | A1 | 2/2000 |
| WO | WO-0016590 | A1 | 3/2000 |
| WO | WO-0019632 | A1 | 4/2000 |
| WO | WO-0021332 | A2 | 4/2000 |
| WO | WO-0022874 | A2 | 4/2000 |
| WO | WO-0036687 | A1 | 6/2000 |
| WO | WO-0036690 | A2 | 6/2000 |
| WO | WO-0036691 | A1 | 6/2000 |
| WO | WO-0036692 | A1 | 6/2000 |
| WO | WO-0128195 | A1 | 4/2001 |
| WO | WO-0135695 | A2 | 5/2001 |
| WO | WO-0139370 | A2 | 5/2001 |
| WO | WO-0145088 | A1 | 6/2001 |
| WO | WO-0151122 | A1 | 7/2001 |
| WO | WO-0154456 | A1 | 7/2001 |
| WO | WO-0154458 | A2 | 7/2001 |
| WO | WO-0169830 | A2 | 9/2001 |
| WO | WO-0176321 | A1 | 10/2001 |
| WO | WO-0193627 | A2 | 12/2001 |
| WO | WO-0197564 | A2 | 12/2001 |
| WO | WO-0209363 | A2 | 1/2002 |
| WO | WO-0209473 | A2 | 1/2002 |
| WO | WO-0230157 | A2 | 4/2002 |
| WO | WO-03063546 | A1 | 7/2003 |

OTHER PUBLICATIONS

"U.S. Appl. No. 08/896,484, Advisory Action mailed Jan. 29, 2002", 3 pgs.
"U.S. Appl. No. 08/896,484, Final Office Action mailed May 9, 2000", 7 pgs.
"U.S. Appl. No. 08/896,484, Final Office Action mailed Sep. 10, 2001", 14 pgs.
"U.S. Appl. No. 08/896,484, Non Final Office Action mailed Feb. 28, 2001", 16 pgs.
"U.S. Appl. No. 08/896,484, Non Final Office Action mailed Aug. 10, 1999", 6 pgs.
"U.S. Appl. No. 08/896,484, Non Final Office Action mailed Aug. 30, 2000", 16 pgs.
"U.S. Appl. No. 08/896,484, Notice of Allowance mailed Mar. 26, 2002", 4 pgs.
"U.S. Appl. No. 08/896,484, Response filed Feb. 10, 2000 to Non Final Office Action mailed Aug. 10, 1999", 3 pgs.
"U.S. Appl. No. 08/896,484, Response filed Feb. 11, 2002 to Advisory Action mailed Jan. 29, 2002", 6 pgs.
"U.S. Appl. No. 08/896,484, Response filed Jun. 28, 2001 to Non Final Office Action mailed Feb. 28, 2001", 13 pgs.
"U.S. Appl. No. 08/896,484, Response filed Aug. 3, 2000 to Final Office Action mailed May 9, 2000", 3 pgs.
"U.S. Appl. No. 08/896,484, Response filed Nov. 8, 2001 to Final Office Action mailed Sep. 10, 2001", 12 pgs.
"U.S. Appl. No. 08/896,484, Response filed Nov. 30, 2000 to Non Final Office Action mailed Aug. 30, 2000", 4 pgs.
"U.S. Appl. No. 09/004,788, Examiner Interview Summary mailed Oct. 17, 2000", 1 pg.
"U.S. Appl. No. 09/004,788, Final Office Action mailed Mar. 31, 2000", 5 pgs.
"U.S. Appl. No. 09/004,788, Non Final Office Action mailed Mar. 23, 2001", 8 pgs.
"U.S. Appl. No. 09/004,788, Non Final Office Action mailed Jul. 16, 1999", 10 pgs.
"U.S. Appl. No. 09/004,788, Notice of Allowance mailed Oct. 2, 2001", 7 pgs.
"U.S. Appl. No. 09/004,788, Preliminary Amendment mailed Sep. 29, 2000", 6 pgs.
"U.S. Appl. No. 09/004,788, Response filed Jun. 25, 2001 to Non Final Office Action mailed Mar. 23, 2001", 7 pgs.
"U.S. Appl. No. 09/152,416, Final Office Action mailed Apr. 23, 2001", 7 pgs.
"U.S. Appl. No. 09/152,416, Non Final Office Action mailed May 2, 2000", 6 pgs.
"U.S. Appl. No. 09/152,416, Non Final Office Action mailed Nov. 3, 2000", 7 pgs.
"U.S. Appl. No. 09/152,416, Notice of Allowance mailed Apr. 8, 2002", 4 pgs.
"U.S. Appl. No. 09/152,416, Notice of Allowance mailed Oct. 19, 2001", 4 pgs.
"U.S. Appl. No. 09/152,416, Response filed Feb. 5, 2001 to Non Final Office Action mailed Nov. 3, 2000", 5 pgs.
"U.S. Appl. No. 09/152,416, Response filed Sep. 24, 2001 to Final Office Action mailed Apr. 23, 2001", 2 pgs.
"U.S. Appl. No. 09/152,416, Response filed Oct. 2, 2000 to Non Final Office Action mailed May 2, 2000", 7 pgs.
"U.S. Appl. No. 09/492,913, Appeal Brief filed Apr. 2, 2007", 38 pgs.
"U.S. Appl. No. 09/492,913, Appeal Brief filed Apr. 14, 2008", 35 pgs.
"U.S. Appl. No. 09/492,913, Final Office Action mailed Apr. 20, 2005", 21 pgs.
"U.S. Appl. No. 09/492,913, Final Office Action mailed Jun. 2, 2006", 24 pgs.
"U.S. Appl. No. 09/492,913, Non-Final Office Action mailed Jun. 2, 2004", 15 pgs.
"U.S. Appl. No. 09/492,913, Non-Final Office Action mailed Jul. 13, 2007", 20 pgs.
"U.S. Appl. No. 09/492,913, Non-Final Office Action mailed Oct. 26, 2005", 21 pgs.
"U.S. Appl. No. 09/492,913, Preliminary Amendment filed Jan. 20, 2000", 1 pg.
"U.S. Appl. No. 09/492,913, Response filed Feb. 27, 2006 to Non-Final Office Action mailed Oct. 26, 2005", 26 pgs.
"U.S. Appl. No. 09/492,913, Response filed Mar. 2, 2004 to Restriction Requirement mailed Feb. 2, 2004", 1 pg.
"U.S. Appl. No. 09/492,913, Response filed Nov. 2, 2004 to Non-Final Office Action mailed Jun. 2, 2004", 24 pgs.
"U.S. Appl. No. 09/492,913, Response to Notification of Non-Compliant Appeal Brief filed May 19, 2008", 2 pgs.
"U.S. Appl. No. 09/492,913, Restriction Requirement mailed Feb. 2, 2004", 4 pgs.
"U.S. Appl. No. 09/795,829, 312 Amendment filed Feb. 21, 2006", 9 pgs.
"U.S. Appl. No. 09/795,829, Final Office Action mailed Aug. 9, 2004", 7 pgs.
"U.S. Appl. No. 09/795,829, Non Final Office Action mailed Jun. 11, 2003", 12 pgs.
"U.S. Appl. No. 09/795,829, Non Final Office Action mailed Jun. 28, 2001", 9 pgs.
"U.S. Appl. No. 09/795,829, Non Final Office Action mailed Dec. 11, 2001", 9 pgs.
"U.S. Appl. No. 09/795,829, Non Final Office Action mailed Dec. 23, 2002", 10 pgs.
"U.S. Appl. No. 09/795,829, Notice of Allowance mailed Jan. 21, 2004", 8 pgs.
"U.S. Appl. No. 09/795,829, Notice of Allowance mailed Jun. 24, 2004", 5 pgs.
"U.S. Appl. No. 09/795,829, Notice of Allowance mailed Nov. 14, 2003", 6 pgs.
"U.S. Appl. No. 09/795,829, Notice of Allowance mailed Nov. 21, 2005", 8 pgs.
"U.S. Appl. No. 09/795,829, Preliminary Amendment filed Feb. 28, 2001", 4 pgs.
"U.S. Appl. No. 09/795,829, PTO Response to 312 Amendment mailed Apr. 10, 2006", 2 pgs.
"U.S. Appl. No. 09/795,829, Response filed Mar. 24, 2003 to Non Final Office Action mailed Dec. 23, 2002", 15 pgs.
"U.S. Appl. No. 09/795,829, Response filed Jun. 11, 2002 to Non Final Office Action mailed Dec. 11, 2001", 10 pgs.
"U.S. Appl. No. 09/795,829, Response filed Sep. 28, 2001 to Non Final Office Action mailed Jun. 28, 2001", 6 pgs.
"U.S. Appl. No. 09/795,829, Response filed Oct. 14, 2003 to Non Final Office Action mailed Jun. 11, 2003", 14 pgs.
"U.S. Appl. No. 09/795,829, Response filed Nov. 12, 2002 to Final Office Action mailed Aug. 9, 2002", 5 pgs.
"U.S. Appl. No. 10/096,335, Comments on Statement of Reasons for Allowance filed Dec. 30, 2004", 1 pg.
"U.S. Appl. No. 10/096,335, Final Office Action mailed Jul. 15, 2003", 12 pgs.

"U.S. Appl. No. 10/096,335, Non Final Office Action mailed Feb. 11, 2004", 7 pgs.
"U.S. Appl. No. 10/096,335, Non Final Office Action mailed Oct. 3, 2002", 14 pgs.
"U.S. Appl. No. 10/096,335, Notice of Allowance mailed Nov. 18, 2004", 16 pgs.
"U.S. Appl. No. 10/096,335, Preliminary Amendment mailed Mar. 11, 2002", 1 pg.
"U.S. Appl. No. 10/096,335, Response filed Jan. 14, 2004 to Final Office Action mailed Jul. 15, 2003", 14 pgs.
"U.S. Appl. No. 10/096,335, Response filed Apr. 3, 2003 to Non Final Office Action mailed Oct. 3, 2002", 14 pgs.
"U.S. Appl. No. 10/096,335, Response filed Jun. 10, 2004 to Non Final Office Action mailed Feb. 11, 2004", 11 pgs.
"U.S. Appl. No. 10/096,335, Supplemental Notice of Allowability mailed Dec. 27, 2004", 3 pgs.
"U.S. Appl. No. 10/112,965, Advisory Action mailed Apr. 17, 2003", 2 pgs.
"U.S. Appl. No. 10/112,965, Final Office Action mailed Jan. 27, 2003", 11 pgs.
"U.S. Appl. No. 10/112,965, Non Final Office Action mailed Sep. 23, 2002", 11 pgs.
"U.S. Appl. No. 10/112,965, Notice of Allowance mailed Jun. 6, 2003", 5 pgs.
"U.S. Appl. No. 10/112,965, Response filed Mar. 27, 2003 to Final Office Action mailed Jan. 27, 2003", 7 pgs.
"U.S Appl. No. 10/112,965, Response filed Nov. 19, 2002 to Non Final Office Action mailed Sep. 23, 2002", 6 pgs.
"U.S. Appl. No. 10/241,764, Final Office Action mailed Jun. 11, 2003", 9 pgs.
"U.S. Appl. No. 10/241,764, Non Final Office Action mailed Jan. 8, 2004", 9 pgs.
"U.S. Appl. No. 10/241,764, Non Final Office Action mailed Jan. 15, 2003", 12 pgs.
"U.S. Appl. No. 10/241,764, Notice of Allowance mailed Sep. 29, 2004", 16 pgs.
"U.S. Appl. No. 10/241,764, Preliminary Amendment filed Sep. 10, 2002", 2 pgs.
"U.S. Appl. No. 10/241,764, Response filed Apr. 14, 2003 to Non Final Office Action mailed Jan. 15, 2003", 13 pgs.
"U.S. Appl. No. 10/241,764, Response filed Jun. 8, 2004 to Non Final Office Action mailed Jan. 8, 2004", 11 pgs.
"U.S. Appl. No. 10/241,764, Response filed Sep. 11, 2003 to Final Office Action mailed Jun. 11, 2003", 5 pgs.
"U.S. Appl. No. 10/698,333, Non Final Office Action mailed Aug. 3, 2004", 12 pgs.
"U.S. Appl. No. 10/698,333, Notice of Allowance mailed Dec. 8, 2004", 7 pgs.
"U.S. Appl. No. 10/698,333, Preliminary Amendment filed Jun. 3, 2004", 6 pgs.
"U.S. Appl. No. 10/698,333, Response filed Nov. 3, 2004 to Non Final Office Action mailed Aug. 3, 2004", 9 pgs.
"U.S. Appl. No. 10/698,333, Supplemental Notice of Allowability mailed Feb. 11, 2005", 2 pgs.
"U.S. Appl. No. 10/698,333, Supplemental Notice of Allowability mailed Mar. 1, 2005", 2 pgs.
"U.S. Appl. No. 10/698,333, Supplemental Preliminary Amendment filed Jun. 22, 2004", 6 pgs.
"U.S. Appl. No. 10/842,246, 312 Amendment filed Nov. 30, 2009", 5 pgs.
"U.S. Appl. No. 10/842,246, Advisory Action mailed Jul. 2, 2009", 3 pgs.
"U.S. Appl. No. 10/842,246, Ex Parte Quayle Action mailed Apr. 3, 2009", 9 pgs.
"U.S. Appl. No. 10/842,246, Examiner Interview Summary filed Sep. 9, 2009", 1 pg.
"U.S. Appl. No. 10/842,246, Examiner Interview Summary mailed Jun. 30, 2009", 2 pgs.
"U.S. Appl. No. 10/842,246, Non-Final Office Action mailed Nov. 6, 2008", 13 pgs.
"U.S. Appl. No. 10/842,246, Notice of Allowance mailed Oct. 1, 2009", 8 pgs.
"U.S. Appl. No. 10/842,246, Notice of Allowance mailed Nov. 12, 2009", 9 pgs.
"U.S. Appl. No. 10/842,246, Response filed Mar. 6, 2009 to Non-Final Office Action mailed Nov. 6, 2008", 7 pgs.
"U.S. Appl. No. 10/842,246, Response filed Aug. 4, 2008 to Restriction Requirement mailed Jul. 2, 2008", 8 pgs.
"U.S. Appl. No. 10/842,246, Response filed Jun. 10, 2009 to Ex parte Quayle Office Action mailed Apr. 3, 2009", 6 pgs.
"U.S. Appl. No. 10/842,246, Restriction Requirement mailed Jul. 2, 2008", 7 pgs.
"U.S. Appl. No. 10/842,246, Supplemental Notice of Allowability mailed Oct. 15, 2009", 3 pgs.
"U.S. Appl. No. 11/036,197, Advisory Action mailed Mar. 18, 2008", 3 pgs.
"U.S. Appl. No. 11/036,197, Advisory Action mailed Apr. 3, 2007", 3 pgs.
"U.S. Appl. No. 11/036,197, Final Office Action mailed Jan. 2, 2008", 13 pgs.
"U.S. Appl. No. 11/036,197, Final Office Action mailed Jan. 23, 2007", 13 pgs.
"U.S. Appl. No. 11/036,197, Non Final Office Action mailed Jun. 4, 2007", 11 pgs.
"U.S. Appl. No. 11/036,197, Non Final Office Action mailed Aug. 15, 2006", 24 pgs.
"U.S. Appl. No. 11/036,197, Notice of Allowance mailed Jul. 1, 2008", 6 pgs.
"U.S. Appl. No. 11/036,197, Preliminary Amendment mailed May 23, 2005", 5 pgs.
"U.S. Appl. No. 11/036,197, Response filed Mar. 3, 2008 to Final Office Action mailed Jan. 2, 2008", 8 pgs.
"U.S. Appl. No. 11/036,197, Response filed Mar. 23, 2007 to Final Office Action mailed Jan. 23, 2007", 10 pgs.
"U.S. Appl. No. 11/036,197, Response filed Oct. 4, 2007 to Non-Final Office Action mailed Jun. 4, 2007", 8 pgs.
"U.S. Appl. No. 11/036,197, Response filed Nov. 15, 2006 to Non Final Office Action mailed Aug. 15, 2006", 9 pgs.
"U.S. Appl. No. 11/036,197, Supplemental Preliminary Amendment filed Jul. 13, 2005", 5 pgs.
"U.S. Appl. No. 11/087,081, Non Final Office Action mailed Mar. 15, 2006", 6 pgs.
"U.S. Appl. No. 11/212,406, Final Office Action mailed Feb. 8, 2010", 27 pgs.
"U.S. Appl. No. 11/212,406, Final Office Action mailed May 18, 2007", 14 pgs.
"U.S. Appl. No. 11/212,406, Final Office Action mailed on Sep. 17, 2008", 24 pgs.
"U.S. Appl. No. 11/212,406, Non Final Office Action mailed Sep. 19, 2006", 13 pgs.
"U.S. Appl. No. 11/212,406, Non-Final Office Action mailed Feb. 4, 2008", 15 pgs.
"U.S. Appl. No. 11/212,406, Non-Final Office Action mailed Sep. 4, 2009", 23 pgs.
"U.S. Appl. No. 11/212,406, Response filed Feb. 19, 2007 to Non Final Office Action mailed Sep. 19, 2006", 15 pgs.
"U.S. Appl. No. 11/212,406, Response filed Jun. 4, 2008 to Non Final Office Action mailed Feb. 4, 2008", 13 pgs.
"U.S. Appl. No. 11/212,406, Response filed Jun. 17, 2009 to Final Office Action mailed Sep. 17, 2008", 15 pgs.
"U.S. Appl. No. 11/212,406, Response filed Oct. 31, 2007 to Final Office Action mailed May 18, 2007", 14 pgs.
"U.S. Appl. No. 11/212,406, Response filed Dec. 4, 2009 to Non Final Office Action mailed Sep. 4, 2009", 16 pgs.
"U.S. Appl. No. 11/331,827, Preliminary Amendment filed Jan. 13, 2006", 3 pgs.
"U.S. Appl. No. 11/857,283, Non-Final Office Action mailed Oct. 8, 2009", 14 pgs.
"U.S. Appl. No. 11/857,283, Response filed Feb. 8, 2010 to Non Final Office Action mailed Oct. 8, 2009", 12 pgs.
"Canadian Application Serial No. 2,343,986, Office Action Mailed Dec. 12, 2008", 2 pgs.
"Canadian Application Serial No. 2,396,771, Office Action mailed Oct. 27, 2008", 5 pgs.

"Canadian Application Serial No. 2,506,957, Office Action mailed Apr. 14, 2008", 3 pgs.
"Canadian Application Serial No. 2223660, Office Action mailed May 5, 2008", 5 pgs.
"European Application Serial No. 05252864.3, Office Action mailed Apr. 29, 2009", 4 pgs.
"European Application Serial No. 05252864.3, Office Action mailed Oct. 13, 2008", 4 pgs.
"European Application Serial No. 07253666.7, European Search Report mailed Oct. 10, 2008", 7 pgs.
"European Application Serial No. 07253666.7, Office Action Mailed Mar. 27, 2009", 1 pg.
"HI-PRO Hearing Instrument Programmer", *GN Otometrics A/S*, (Dec. 2000), 12 pgs.
"Microcard PCMCIA Programming Interface", [Online]. [Archived Oct. 17, 2002]. Retrieved from the Internet: <URL: www.hearing-aid.com/microcard.htm>, (Jun. 22, 2004), 2 pgs.
"Personal Programmer 2000: A Personal Programmer that's practically a PC in your hand!", [Online]. Retrieved from the Internet: <URL: http://www.siemens-hearing.com/products/pprods/persprogmain.html>, (Jun. 24, 1999), 3 pgs.
"Welcome Page", *Micro Audiometrics Corp.*, [Online]. Retrieved from the Internet: <URL: http://www.microaud.com>, (May 26, 1999), 17 pgs.
"What is PCMCIA", [Online]. Retrieved from the Internet: <URL: http://pw2.netcom.com/~ed13/pcmcia.html>, (Nov. 14, 1996), 3 pgs.
Anderson, Blane A., "A PCMCIA Card for Programmable Instrument Applications", *Tech-Topic, reprinted from The Hearing Review*, vol. 4, No. 9, (Sep. 1997), 47-48.
Armitage, Scott, et al., "Microcard: A new hearing aid programming interface", *Hearing Journal*, 51(9), (Sep. 1998), 37-32.
Clancy, David A, "Highlighting developments in hearing aids", *Hearing Instruments*, (Dec. 1995), 2.
Davis, Leroy, "Interface Between Data Terminal Equipment and Data Circuit Terminating Equipment Employing Serial Binary Data Interchange", www.interfacebus.com/Design Connector RS232.html. EIA-232 Bus, (Jul. 2, 2006), 1-6.
Eaton, Anthony M, et al., "Hearing Aid Systems", U.S. Appl. No. 09/492,913, filed Jan. 20, 2000, 56 pgs.
Griffing, Terry S, et al., "Acoustical Efficiency of Canal ITE Aids", *Audecibel*, (Spring 1983), 30-31.
Griffing, Terry S, et al., "Custom canal and mini in-the-ear hearing aids", *Hearing Instruments*, vol. 34, No. 2, (Feb. 1983), 31-32.
Griffing, Terry S, et al., "How to evaluate, sell, fit and modify canal aids", *Hearing Instruments*, vol. 35, No. 2, (Feb. 1984), 3.
Ingrao, B., "Audiology Unplugged: Leading hearing care into the Bluetooth Age", *Hearing Review*, (Jan. 2006), 6 pgs.
Mahon, William J, "Hearing Aids Get a Presidential Endorsement", *The Hearing Journal.*, (Oct. 1983), 7-8.
Micro Audiometrics Corporation, "Micro Audiometrics Corporation Web Page", http://www/microaud.com, Internet webpage, (May 26, 1999), 11 pgs.
Sullivan, Roy F, "Custom canal and concha hearing instruments: A real ear comparison Part I", *Hearing Instruments*, vol. 40, No. 4, (Jul. 1989), 23-29.
Sullivan, Roy F, "Custom canal and concha hearing instruments: A real ear comparison Part II", *Hearing Instruments*, vol. 40, No. 7, (Jul. 1989), 30-36.
"U.S. Appl. No. 10/842,246, Notice of Allowance mailed Mar. 24, 2010", 7 Pgs.
"Canadian Application No. 2601662, Office Action Mailed Feb. 8, 2010", 5 pgs.
"U.S. Appl. No. 11/212,406 Non-Final Office Action mailed Jul. 19, 2010", 20 Pgs.
"U.S. Appl. No. 11/857,283 Non-Final Office Action mailed Sep. 24, 2010", 11 Pgs.
"U.S. Appl. No. 11/857,283, Final Office Action mailed May 12, 2010", 13 Pgs.
"U.S. Appl. No. 11/857,283, Response filed Sep. 13, 2010 to Final Office Action mailed May 12, 2010", 8 Pgs.
"Australian Application Serial No. 2007216810 , First Examiner Report mailed May 27, 2010", 2 Pgs.
"Canadian Application Serial No. 2601662, Office Action Response Filed Aug. 17, 2010", 9 pgs.
"European Application Serial No. 97403015.7, Office Action mailed Jul. 30, 2010", 4 Pgs.

PORTABLE SYSTEM FOR PROGRAMMING HEARING AIDS

CROSS REFERENCE TO RELATED APPLICATION

This application is a continuation of U.S. patent application Ser. No. 10/842,246, filed May 10, 2004 now U.S. Pat. No. 7,787,647, which is a continuation-in-part of U.S. patent application Ser. No. 10/096,335, filed Mar. 11, 2002 now U.S. Pat. No. 6,888,948, which is a continuation of U.S. patent application Ser. No. 08/896,484, filed on Jul. 18, 1997, now issued as U.S. Pat. No. 6,424,722, which is a continuation-in-part of U.S. patent application Ser. No. 08/782,328, filed on Jan. 13, 1997, now abandoned, all of which are commonly assigned and incorporated here.

FIELD OF THE INVENTION

This application relates generally to a programming system for programmable hearing aids and, more particularly, to a hearing aid programming system utilizing a host computer which uses a wired or wireless connection to communicate data to a hearing aid programmer, which is further suited to wirelessly program hearing aids.

BACKGROUND

Hearing aids have been developed to ameliorate the effects of hearing losses in individuals. Hearing deficiencies can range from deafness to hearing losses where the individual has impairment of responding to different frequencies of sound or to being able to differentiate sounds occurring simultaneously. The hearing aid in its most elementary form usually provides for auditory correction through the amplification and filtering of sound provided in the environment with the intent that the individual can hear better than without the amplification.

Various hearing aids offer adjustable operational parameters to optimize hearing and comfort to the individual. Parameters, such as volume or tone, may easily be adjusted, and many hearing aids allow for the individual to adjust these parameters. It is usual that an individual's hearing loss is not uniform over the entire frequency spectrum of audible sound. An individual's hearing loss may be greater at higher frequency ranges than at lower frequencies. Recognizing these differentiations in hearing loss considerations between individuals, it has become common for a hearing health professional to make measurements that will indicate the type of correction or assistance that will improve that individual's hearing capability. A variety of measurements may be taken, which can include establishing speech recognition scores, or measurement of the individual's perceptive ability for differing sound frequencies and differing sound amplitudes. The resulting score data or amplitude/frequency response can be provided in tabular form or graphically represented, such that the individual's hearing loss may be compared to what would be considered a more normal hearing response. To assist in improving the hearing of individuals, it has been found desirable to provide adjustable hearing aids wherein filtering parameters may be adjusted, and automatic gain control (AGC) parameters are adjustable.

With the development of microelectronics and microprocessors, programmable hearing aids have become well known. It is known for programmable hearing aids to have a digital control section which stores auditory data and which controls aspects of signal processing characteristics. Such programmable hearing aids also have a signal processing section, which may be analog or digital, and which operates under control of the control section to perform the signal processing or amplification to meet the needs of the individual.

There are several types of hearing aid programming interface systems. One type of programming system includes a custom designed stand-alone programmer that is self-contained and provides programming functions known at the time of design. Stand-alone programmers tend to be inflexible and difficult to update and modify, thereby raising the cost to stay current. Further, such stand-alone programmers are normally designed for handling a limited number of hearing aid types and lack versatility. Should there be an error in the system that provides the programming, such stand-alone systems tend to be difficult to repair or upgrade.

Another type of hearing aid programming interface is a programmer that is designed to install into and become part of a host computing system. Hearing aid programmers of the type that plug into host computers are generally designed to be compatible with the expansion ports on a specific computer. Past systems have generally been designed to plug into the bus structure known as the Industry Standard Architecture (ISA). However, the ISA expansion bus is not available on many host computers. For example, most laptop computers do not have an ISA expansion bus. Further, plugging cards into available ISA expansion ports requires opening the computer cabinet and appropriately installing the expansion card.

SUMMARY

The above-mentioned problems and others not expressly discussed herein are addressed by the present subject matter and will be understood by reading and studying this specification.

The present subject matter includes, in part, a system for programming one or more hearing aids with a host computer, the system including a hearing aid programmer for wireless communications with the host computer. In various embodiments, the hearing aid programmer has at least one interface connector for communication with at least one hearing aid. Additionally, in various embodiments, the system includes a wireless interface adapted for connecting to at least one interface connector of the hearing aid programmer, the wireless interface further adapted for wireless communication with one or more hearing aids. Varying embodiments of the present subject matter include a wireless interface which contains signal processing electronics, a memory connected to the signal processing electronics; and a wireless module connected to the signal processing electronics and adapted for wireless communications.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

BRIEF DESCRIPTION OF THE DRAWINGS

Various embodiments are illustrated by way of example and not by way of limitation in the figures of the accompanying drawings in which like references indicate similar elements.

DETAILED DESCRIPTION

Figure 1:
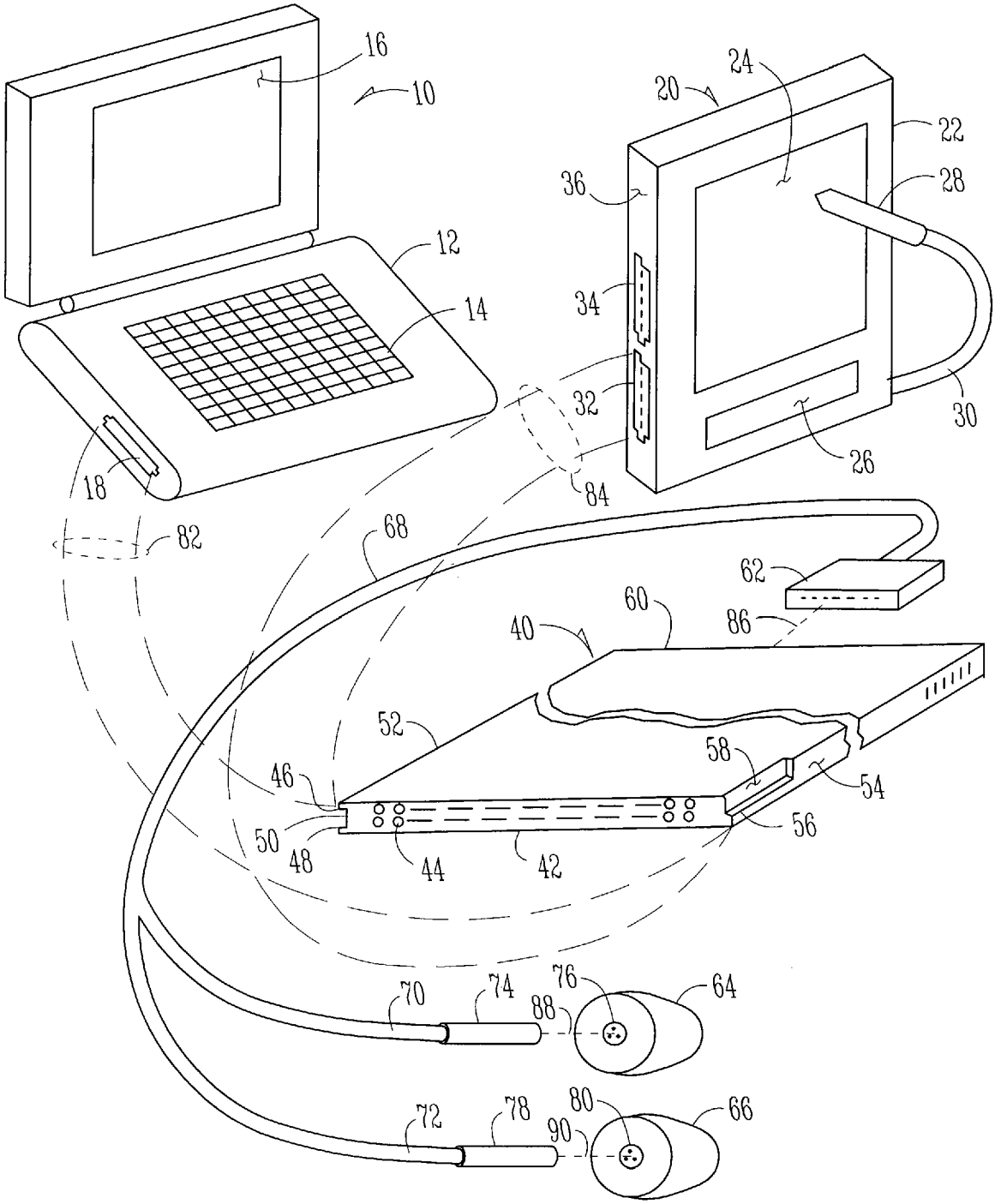
FIG. 1 is a pictorial view of one embodiment of an improved hearing aid programming system of the present subject matter.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. It will be apparent, however, to one skilled in the art that the various embodiments may be practiced without some of these specific details. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

It is generally known that a person's hearing loss is not normally uniform over the entire frequency spectrum of hearing. For example, in typical noise-induced hearing loss, the hearing loss is typically greater at higher frequencies than at lower frequencies. The degree of hearing loss at various frequencies varies with individuals. The measurement of an individual's hearing ability can be illustrated by an audiogram. An audiologist, or other hearing health professionals, will measure an individual's perceptive ability for differing sound frequencies and differing sound amplitudes. A plot of the resulting information in an amplitude/frequency diagram will graphically represent the individual's hearing ability, and will thereby represent the individual's hearing loss as compared to an established range of normal hearing for individuals. In this regard, the audiogram represents graphically the particular auditory characteristics of the individual. Other types of measurements relating to hearing deficiencies may be made. For example, speech recognition scores can be utilized. It is understood that the auditory characteristics of an individual or other measured hearing responses may be represented by data that can be represented in various tabular forms as well as in the graphical representation.

Basically, a hearing aid consists of a sound actuatable microphone for converting environmental sounds into an electrical signal. The electrical signal is supplied to an amplifier for providing an amplified output signal. The amplified output signal is applied to a receiver that acts as a loudspeaker for converting the amplified electrical signal into sound that is transmitted to the individual's ear. The various kinds of hearing aids can be configured to be "completely in the canal" known as the CIC type of hearing aid. Hearing aids can also be embodied in configurations such as "in the ear", "in the canal", "behind the ear", embodied in an eyeglass frame, worn on the body, and surgically implanted. Each of the various types of hearing aids have differing functional and aesthetic characteristics. Further, hearing aids can be programmed through analog parametric adjustments or through digital programs.

Since individuals have differing hearing abilities with respect to each other, and oftentimes have differing hearing abilities between the right and left ears, it is normal to have some form of adjustment to compensate for the characteristics of the hearing of the individual. It has been known to provide an adjustable filter for use in conjunction with the amplifier for modifying the amplifying characteristics of the hearing aid. Various forms of physical adjustment for adjusting variable resistors or capacitors have been used. With the advent of microcircuitry, the ability to program hearing aids has become well-known. A programmable hearing aid typically has a digital control section and a signal processing section. The digital control section is adapted to store an auditory parameter, or a set of auditory parameters, which will control an aspect or set of aspects of the amplifying characteristics, or other characteristics, of the hearing aid. The signal processing section of the hearing aid then will operate in response to the control section to perform the actual signal processing, or amplification, it being understood that the signal processing may be digital or analog.

Numerous types of programmable hearing aids are known. As such, details of the specifics of programming functions will not be described in detail. To accomplish the programming, it has been known to have the manufacturer establish a computer-based programming function at its factory or outlet centers. In this form of operation, the details of the individual's hearing readings, such as the audiogram, are forwarded to the manufacturer for use in making the programming adjustments. Once adjusted, the hearing aid or hearing aids are then sent to the intended user. Such an operation clearly suffers from the disadvantage of the loss of time in the transmission of the information and the return of the adjusted hearing aid, as well as not being able to provide inexpensive and timely adjustments with the individual user. Such arrangements characteristically deal only with the programming of the particular manufacturer's hearing aids, and are not readily adaptable for adjusting or programming various types of hearing aids.

Yet another type of prior art programming system is utilized wherein the programming system is located near the hearing health professional who would like to program the hearing aid for patients. In such an arrangement, it is common for each location to have a general purpose computer especially programmed to perform the programming function and provide it with an interface unit hard-wired to the computer for providing the programming function to the hearing aid. In this arrangement, the hearing professional enters the audiogram or other patient-related hearing information into the computer, and thereby allows the computer to calculate the auditory parameters that will be optimal for the predetermined listening situations for the individual. The computer then directly programs the hearing aid. Such specific programming systems and hard-wired interrelationship to the host computer are costly and do not lend themselves to ease of altering the programming functions.

Other types of programming systems wherein centralized host computers are used to provide programming access via telephone lines and the like are also known, and suffer from many of the problems of cost, lack of ease of usage, lack of flexibility in reprogramming, and the like.

A number of these prior art programmable systems have been identified above, and their respective functionalities will not be further described in detail.

The system and method of programming hearing aids of the present subject matter provides a mechanism where the hearing aid programming system can be economically located at the office of each hearing health professional, thereby overcoming many of the described deficiencies of prior art programming systems.

In various embodiments of the present subject matter, groups of computing devices, including lap top computers, notebook computers, hand-held computers, and the like, which can collectively be referenced as host computers, are adapted to support the Personal Computer Memory Card International Association Technology, which is generally referred to as PCMCIA. In general, PCMCIA provides one or more standardized ports in the host computer where such ports are arranged to cooperate with associated PCMCIA PC cards, hereinafter referred to as "Cards". The Cards are utilized to provide various functions, and the functionality of PCMCIA will be described in more detail below. The PCMCIA specification defines a standard for integrated circuit Cards to be used to promote interchangeability among a variety of computer and electronic products. Attention is given to low cost, ruggedness, low power consumption, light weight, and portability of operation.

The specific size of the various configurations of Cards will be described in more detail below, but in general, it is understood that it will be comparable in size to a credit card, thereby achieving the goal of ease of handling. Other goals of PCMCIA technology can be simply stated to require that (1) it must be simple to configure, and support multiple peripheral devices; (2) it must be hardware and operating environment independent; (3) installation must be flexible; and (4) it must be inexpensive to support the various peripheral devices. These goals and objectives of PCMCIA specification requirements and available technology are consistent with the goals of the present subject matter, which are providing an improved highly portable, inexpensive, adaptable hearing aid programming system. The PCMCIA technology is expanding into personal computers and work stations, and it is understood that where such capability is present, the attributes of the present subject matter are applicable. Various aspects of PCMCIA will be described below at points to render the description meaningful to the present subject matter.

FIG. 1 is a pictorial view of one embodiment of an improved hearing aid programming system of the present subject matter. A host computer 10, which can be selected from among lap top computers; notebook computers; personal computers; work station computers; or the like, includes a body portion 12, a control keyboard portion 14, and a display portion 16. While only one PCMCIA port 18 is illustrated, it is understood that such ports may occur singularly or in groups of more than one. Various types of host computers 10 are available commercially from various manufacturers, including, but not limited to, International Business Machines and Apple Computer, Inc. Another type of host computer is the hand-held computer 20. The hand-held host 20 includes a body portion 22, a screen portion 24, a set of controls 26 and a stylus 28. The stylus 28 operates as a means for providing information to the hand-held host computer 20 by interaction with screen 24. A pair of PCMCIA ports 32 and 34 are illustrated aligned along one side 36 of the hand-held host computer 20. Again, it should be understood that more or fewer PCMCIA ports may be utilized. Further, it will be understood that it is possible for the PCMCIA ports to be position in parallel and adjacent to one another as distinguished from the linear position illustrated. A hand-held host computer is available from various sources.

A PCMCIA Card 40 has a first end 42 in which a number of contacts 44 are mounted. In the standard, the contacts 44 are arranged in two parallel rows and number approximately 68. The outer end 60 has a connector (not shown in this figure) to cooperate with mating connector 62. This interconnection provide signals to and from hearing aids 64 and 66 via cable 68 which splits into cable ends 70 and 72. Cable portion 70 has connector 74 affixed thereto and adapted for cooperation with jack 76 in hearing aid 64. Similarly, cable 72 has connector 78 that is adapted for cooperation with jack 80 in hearing aid 66. This configuration allows for programming of hearing aid 64 and 66 in the ears of the individual to use them, it being understood that the cable interconnection may alternatively be a single cable for a single hearing aid or two separate cables with two separations to the Card 40.

It is apparent that card 40 and the various components are not shown in scale with one another, and that the dashed lines represent directions of interconnection. In this regard, a selection can be made between portable host 10 or hand-held host 20. If host 10 is selected, card 40 is moved in the direction of dashed lines 82 for insertion in PCMCIA slot 18. Alternatively, if a hand-held host 20 is to be used, Card 40 is moved along dashed lines 84 for insertion in PCMCIA slot 32. Connector 62 can be moved along dashed line 86 for mating with the connector (not shown) at end 60 of card 40. Connector 74 can be moved along line 88 for contacting jack 76, and connector 78 can be moved along dashed line 90 for contacting jack 80. There are three standardized configurations of Card 40 plus one nonstandard form that will not be described.

Figure 2:
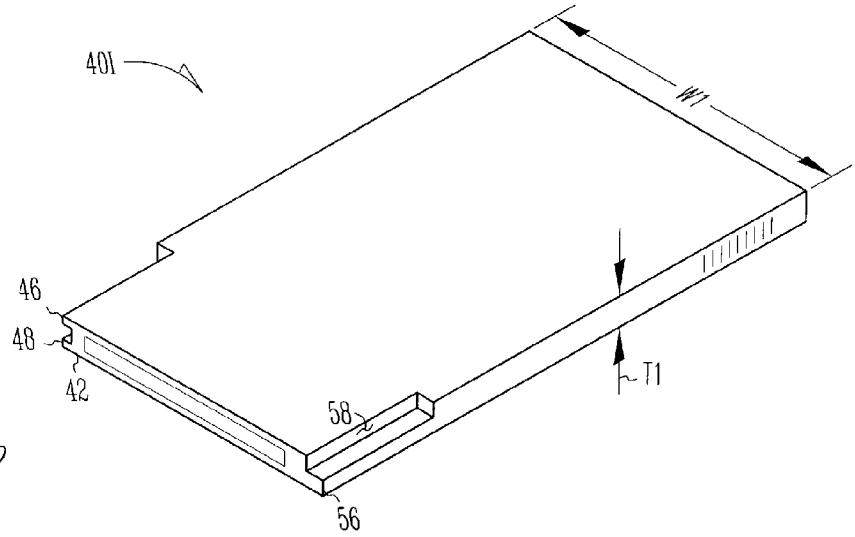
FIG. 2 is a perspective view of a Type I plug-in Card, in one embodiment of the present subject matter.

FIG. 2 is a perspective view of a Type I plug-in Card. The physical configurations and requirements of the various Card types are specified in the PCMCIA specification to assure portability and consistency of operation. Type I Card 40I has a width W1 of approximately 54 millimeters and a thickness T1 of approximately 3.3 millimeters. Other elements illustrated bear the same reference numerals as in FIG. 1.

Figure 3:
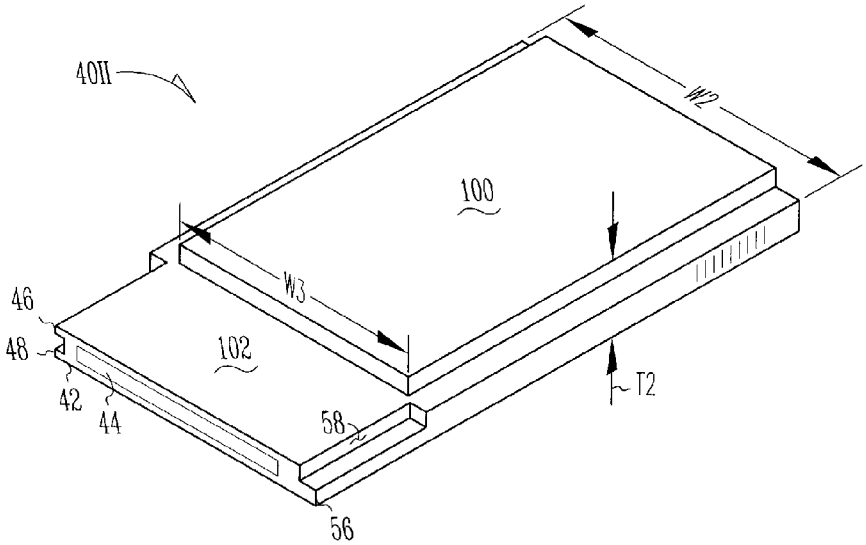
FIG. 3 is a perspective view of a Type II plug-in Card, in one embodiment of the present subject matter.

FIG. 3 is a perspective view of a Type II plug-in Card. Card 40II has a width W2 of approximately 54 millimeters and has a raised portion 100. With the raised portion, the thickness T2 is approximately 5.0 millimeters. The width W3 of raised portion 100 is approximately 48 millimeters. The purpose of raised portion 100 is to provide room for circuitry to be mounted on the surface 102 of card 40II.

Figure 4:
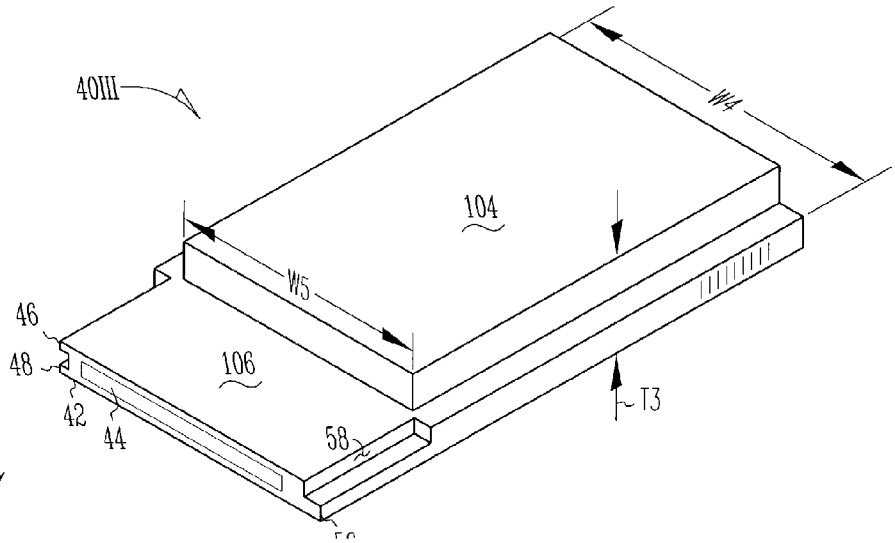
FIG. 4 is a perspective view of a Type III plug-in Card, in one embodiment of the present subject matter.

FIG. 4 is a perspective view of a Type III plug-in Card. Card 40III has a width W4 of approximately 54 millimeters, and an overall thickness T3 of approximately 10.5 millimeters. Raised portion 104 has a width W5 of approximately 51 millimeters, and with the additional depth above the upper surface 106 allows for even larger components to be mounted.

Type II Cards are the most prevalent in usage, and allow for the most flexibility in use in pairs with stacked PCMCIA ports.

The PCMCIA slot includes two rows of approximately 34 pins each. The connector on the Card is adapted to cooperate with these pins. There are approximately three groupings of pins that vary in length. This results in a sequence of operation as the Card is inserted into the slot. The longest pins make contact first, the intermediate length pins make contact second, and the shortest pins make contact last. The sequencing of pin lengths allow the host system to properly sequence application of power and ground to the Card. It is not necessary for an understanding of the present subject matter to consider the sequencing in detail, it being automatically handled as the Card is inserted. Functionally, the shortest pins are the card detect pins and are responsible for routing signals that inform software running on the host of the insertion or removal of a Card. The shortest pins result in this operation occurring last, and functions only after the Card has been fully inserted. It is not necessary for an understanding of the present subject matter that each pin and its function be considered in detail, it being understood that power and ground is provided from the host to the Card.

Figure 5:
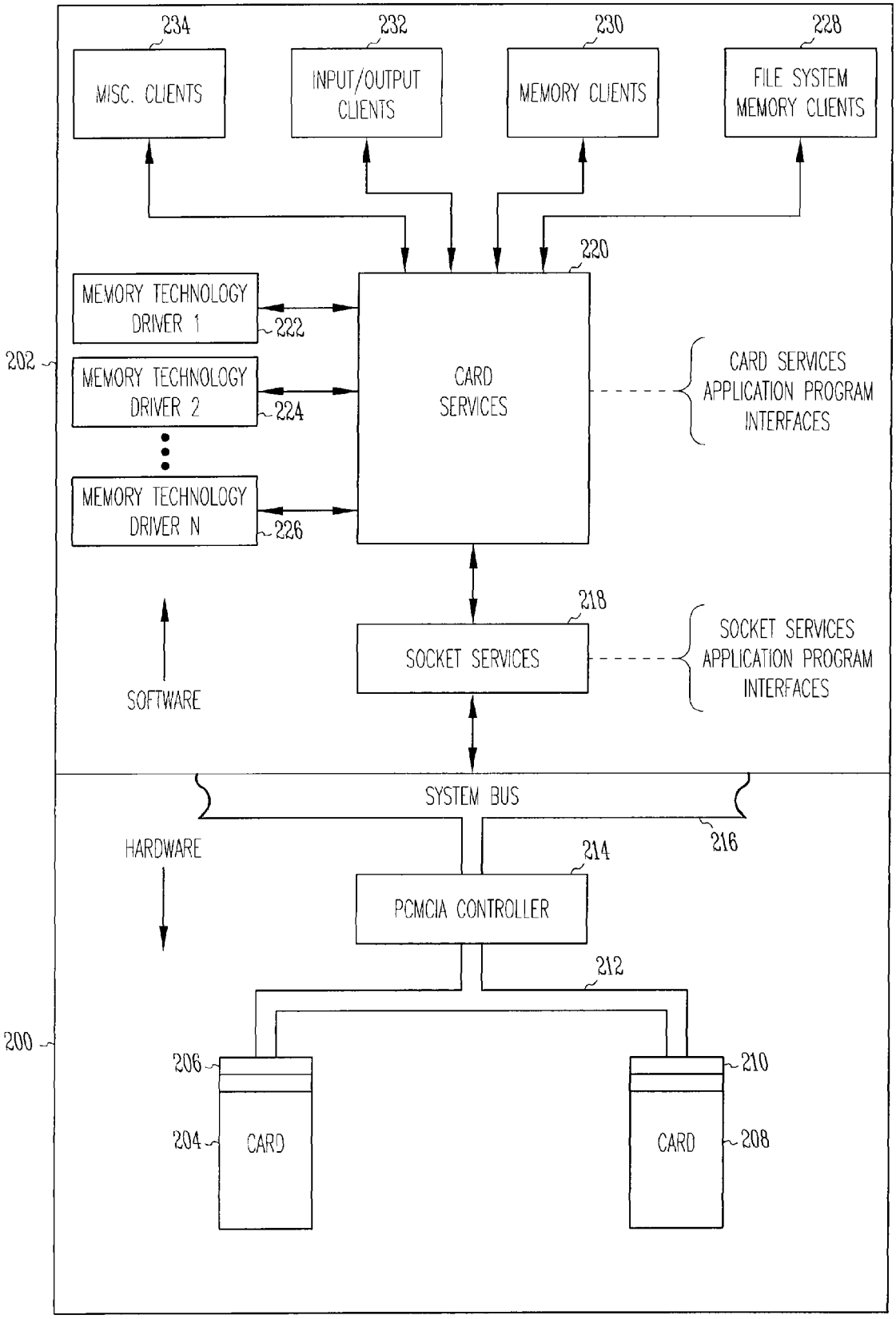
FIG. 5 is a diagram representing the PCMCIA architecture, in one embodiment of the present subject matter.

FIG. 5 is a diagram representing the PCMCIA architecture. The PCMCIA architecture is well-defined and is substantially available on any host computer that is adapted to support the PCMCIA architecture. For purposes of understanding the present subject matter, it is not necessary that the intricate details of the PCMCIA architecture be defined herein, since they are substantially available in the commercial marketplace. It is, however, desirable to understand some basic fundamentals of the PCMCIA architecture in order to appreciate the operation of the present subject matter.

In general terms, the PCMCIA architecture defines various interfaces and services that allow application software to configure Card resources into the system for use by system-level utilities and applications. The PCMCIA hardware and related PCMCIA handlers within the system function as enabling technologies for the Card.

Resources that are capable of being configured or mapped from the PCMCIA bus to the system bus are memory configurations, input/output (I/O) ranges and Interrupt Request Lines (IRQs). Details concerning the PCMCIA architecture can be derived from the specification available from PCMCIA Committee, as well as various vendors that supply PCMCIA components or software commercially.

The PCMCIA architecture involves a consideration of hardware 200 and layers of software 202. Within the hardware consideration, Card 204 is coupled to PCMCIA socket 206 and Card 208 is coupled to PCMCIA socket 210. Sockets 206 and 210 are coupled to the PCMCIA bus 212 which in turn is coupled to the PCMCIA controller 214. Controllers are provided commercially by a number of vendors. The controller 214 is programmed to carry out the functions of the PCMCIA architecture, and responds to internal and external stimuli. Controller 214 is coupled to the system bus 216. The system bus 216 is a set of electrical paths within a host computer over which control signals, address signals, and data signals are transmitted. The control signals are the basis for the protocol established to place data signals on the bus and to read data signals from the bus. The address lines are controlled by various devices that are connected to the bus and are utilized to refer to particular memory locations or I/O locations. The data lines are used to pass actual data signals between devices.

The PCMCIA bus 212 utilizes 26 address lines and 16 data lines.

Within the software 202 consideration, there are levels of software abstractions. The Socket Services 218 is the first level in the software architecture and is responsible for software abstraction of the PCMCIA sockets 206 and 210. In general, Socket Services 218 will be applicable to a particular controller 214. In general, Socket Services 218 uses a register set (not shown) to pass arguments and return status. When interrupts are processed with proper register settings, Socket Services gains control and attempts to perform functions specified at the Application Program Interfaces (API).

Card Services 220 is the next level of abstraction defined by PCMCIA and provides for PCMCIA system initialization, central resource management for PCMCIA, and APIs for Card configuration and client management. Card Services is event-driven and notifies clients of hardware events and responds to client requests. Card Services 220 is also the manager of resources available to PCMCIA clients and is responsible for managing data and assignment of resources to a Card. Card Services assigns particular resources to Cards on the condition that the Card Information Structure (CIS) indicates that they are supported. Once resources are configured to a Card, the Card can be accessed as if it were a device in the system. Card Services has an array of Application Program Interfaces to provide the various required functions.

Memory Technology Driver 1 (MTD) 222, Memory Technology Driver 2, label 224, and Memory Technology Driver N, label 226, are handlers directly responsible for reading and writing of specific memory technology memory Cards. These include standard drivers and specially designed drivers if required.

Card Services 220 has a variety of clients such as File System Memory clients 228 that deal with file system aware structures; Memory Clients 230, Input/Output Clients 232; and Miscellaneous Clients 234.

Figure 6:
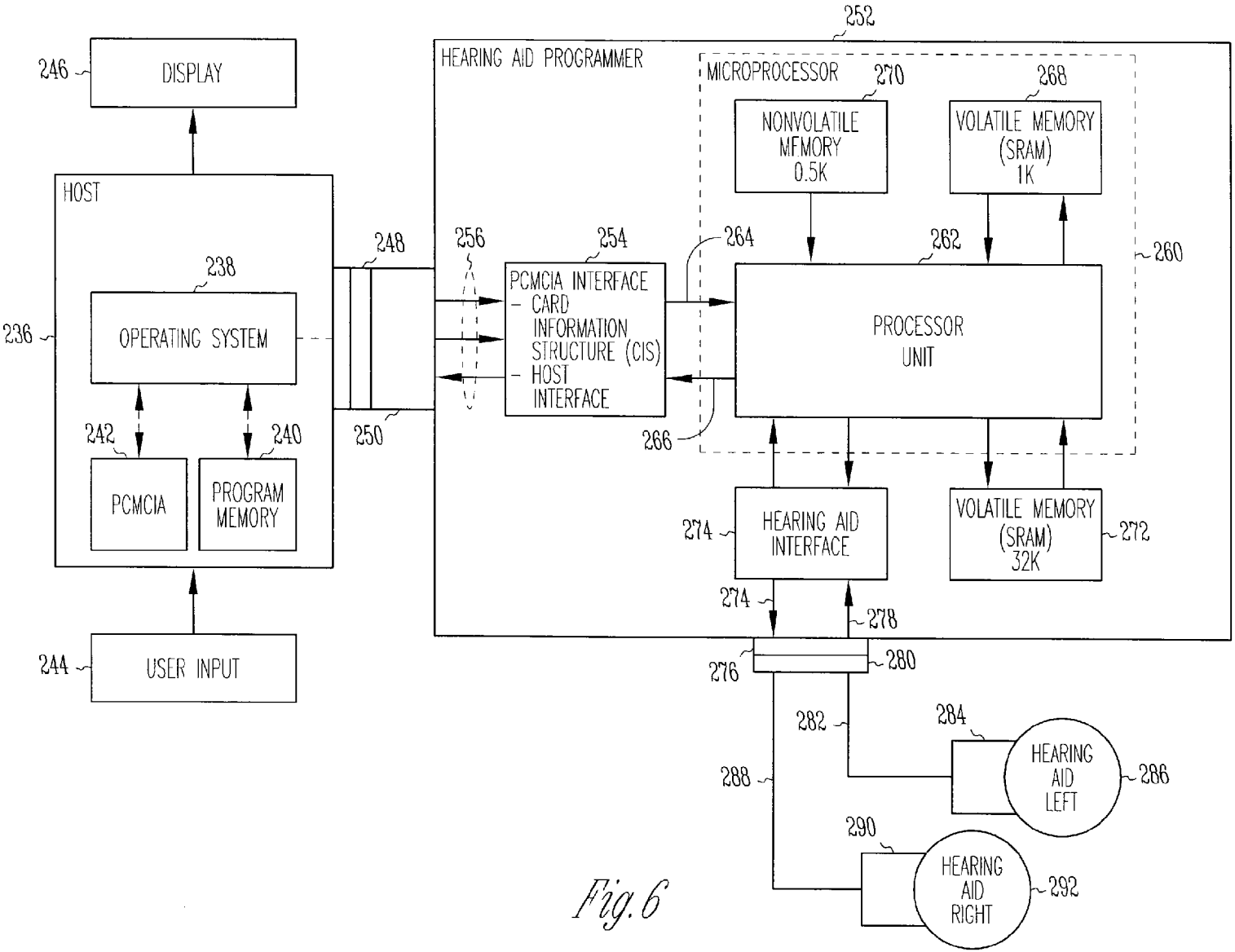
FIG. 6 is a block diagram illustrating the functional interrelationship of a host computer and the Card used for programming hearing aids, in one embodiment of the present subject matter.

FIG. 6 is a block diagram illustrating the functional interrelationship of a host computer and a Card used for programming hearing aids. A Host 236 has an Operating System 238. A Program Memory 240 is available for storing the hearing aid programming software. The PCMCIA block 242 indicates that the Host 236 supports the PCMCIA architecture. A User Input 244 provides input control to Host 236 for selecting hearing aid programming functions and providing data input to Host 236. A Display 246 provides output representations for visual observation. PCMCIA socket 248 cooperates with PCMCIA jack 250 mounted on Card 252.

On Card 252 there is a PCMCIA Interface 254 that is coupled to jack 250 via lines 256, where lines 256 include circuits for providing power and ground connections from Host 236, and circuits for providing address signals, data signals, and control signals. The PCMCIA Interface 254 includes the Card Information Structure (CIS) that is utilized for providing signals to Host 236 indicative of the nature of the Card and setting configuration parameters. The CIS contains information and data specific to the Card, and the components of information in CIS is comprised of tuples, where each tuple is a segment of data structure that describes a specific aspect or configuration relative to the Card. It is this information that will determine whether the Card is to be treated as a standard serial data port, a standard memory card, a unique programming card or the like. The combination of tuples is a metaformat.

A Microprocessor shown within dashed block 260 includes a Processor Unit 262 that receives signals from PCMCIA Interface 254 over lines 264 and provides signals to the Interface over lines 266. An onboard memory system 268 is provided for use in storing program instructions. In the embodiment of the circuit, the Memory 268 is a volatile static random access memory (SRAM) unit of 1 K capacity. A Nonvolatile Memory 270 is provided. The Nonvolatile Memory is 0.5 K and is utilized to store initialization instructions that are activated upon insertion of Card 252 into socket 248. This initialization software is often referred to as "bootstrap" software in that the system is capable of pulling itself up into operation.

A second Memory System 272 is provided. This Memory is coupled to Processor Unit 262 for storage of hearing aid programming software during the hearing aid programming operation. In a preferred embodiment, Memory 272 is a volatile SRAM having a 32 K capacity. During the initialization phases, the programming software will be transmitted from the Program Memory 240 of Host 236 and downloaded through the PCMCIA interface 254. In an alternative embodiment, Memory System 272 can be a nonvolatile memory with the hearing aid programming software stored therein. Such nonvolatile memory can be selected from available memory systems such as Read Only Memory (ROM), Programmable Read Only Memory (PROM), Erasable Programmable Read Only Memory (EPROM), or Electrically Erasable Programmable Read Only Memory (EEPROM). It is, of course, understood that Static Random Access Memory (SRAM) memory systems normally do not hold or retain data stored therein when power is removed.

A Hearing Aid Interface 274 provides the selected signals over lines 274 to the interface connector 276. The Interface receives signals on lines 278 from the interface connector. In general, the Hearing Aid Interface 274 functions under control of the Processor Unit 262 to select which hearing aid will be programmed, and to provide the digital to analog selections, and to provide the programmed impedance levels.

A jack 280 couples with connector 276 and provides electrical connection over lines 282 to jack 284 that couples to hearing aid 286. In a similar manner, conductors 288 coupled to jack 290 for making electrical interconnection with hearing aid 292.

Assuming that Socket Services 218, Card Services 220 and appropriate drivers and handlers are appropriately loaded in the Host 236 (pictured in FIG. 5), the hearing aid programming system is initialized by insertion of Card 252 into socket 248. The insertion processing involves application of power signals first since they are connected with the longest pins. The next longest pins cause the data, address and various control signals to be made. Finally, when the card detect pin is connected, there is a Card status change interrupt. Once stabilized, Card Services queries the status of the PCMCIA slot through the Socket Services, and if the state has changed, further processing continues. At this juncture, Card Services notifies the I/O clients which in turn issues direction to Card Services to read the Card's CIS. The CIS tuples are transmitted to Card Services and a determination is made as to the identification of the Card 252 and the configurations specified. Depending upon the combination of tuples, that is, the metaformat, the Card 252 will be identified to the Host 236 as a particular structure. In a preferred embodiment, Card 252 is identified as a serial memory port, thereby allowing Host 236 to treat with data transmissions to and from Card 252 on that basis. It is, of course, understood that Card 252 could be configured as a serial data Card, a Memory Card or a unique programming Card thereby altering the control and communication between Host 236 and Card 252.

Figure 7:
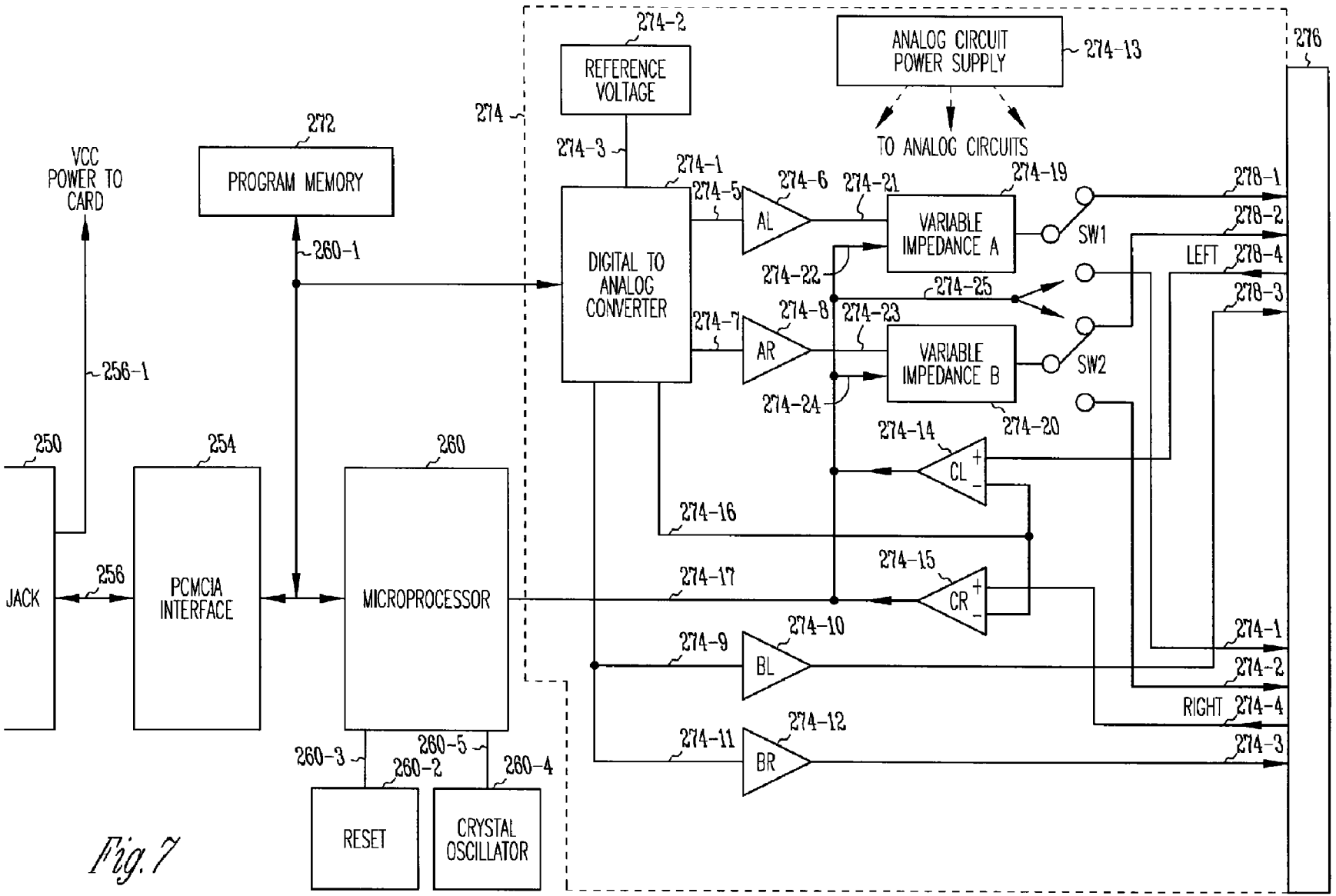
FIG. 7 is a functional block diagram of the hearing aid programming Card, in one embodiment of the present subject matter.

FIG. 7 is a functional block diagram of the hearing aid programming Card.

The PCMCIA jack 250 is coupled to PCMCIA Interface 254 via PCMCIA bus 256, and provides VCC power to the card via line 256-1. The Microprocessor 260 is coupled to the Program Memory 272 via the Microprocessor Bus 260-1. A Reset Circuit 260-2 is coupled via line 260-3 to Microprocessor 260 and functions to reset the Microprocessor when power falls below predetermined limits. A Crystal Oscillator 260-4 is coupled to Microprocessor 260 via line 260-5 and provides a predetermined operational frequency signal for use by Microprocessor 260.

The Hearing Aid Interface shown enclosed in dashed block 274 includes a Digital to Analog Converter 274-1 that is coupled to a Reference Voltage 274-2 via line 274-3. In a preferred embodiment, the Reference Voltage is established at 2.5 volts DC. Digital to Analog Converter 274-1 is coupled to Microprocessor Bus 260-1. The Digital to Analog Converter functions to produce four analog voltages under control of the programming established by the Microprocessor.

One of the four analog voltages is provided on Line 274-5 to amplifier AL, labeled 274-6, which functions to convert 0 to reference voltage levels to 0 to 15 volt level signals. A second voltage is provided on line 274-7 to amplifier AR, labeled 274-8, which provides a similar conversion of 0 volts to the reference voltage signals to 0 volts to 15 volt signals. A third voltage is provided on line 274-9 to the amplifier BL, labeled 274-10, and on line 274-11 to amplifier BR, labeled 274-12. Amplifiers BL and BR convert 0 volt signals to reference voltage signals to 0 volts to 15 volt signals and are used to supply power to the hearing aid being adjusted. In this regard, amplifier BL provides the voltage signals on line 278-3 to the Left hearing aid, and amplifier BR provides the selected voltage level signals on line 274-3 to the Right hearing aid.

An Analog Circuit Power Supply 274-13 provides predetermined power voltage levels to all analog circuits.

A pair of input Comparators CL labeled 274-14 and CR labeled 274-15 are provided to receive output signals from the respective hearing aids. Comparator CL receives input signals from the Left hearing aid via line 278-4 and Comparator CR receives input signals from the Right hearing aid via line 274-4. The fourth analog voltage from Digital to Analog Converter 274-1 is provided on line 274-16 to Comparators CL and CR.

A plurality of hearing aid programming circuit control lines pass from Microprocessor 260 and to the Microprocessor via lines 274-17. The output signals provided by comparators CL and CR advise Microprocessor 260 of parameters concerning the CL and CR hearing aids respectively.

A Variable Impedance A circuit and Variable Impedance B circuit 274-20 each include a predetermined number of analog switches and a like number of resistance elements. In a preferred embodiment as will be described in more detail below, each of these circuits includes eight analog switches and eight resistors. The output from amplifier AL is provided to Variable Impedance A via line 274-21 and selection signals are provided via line 274-22. The combination of the voltage signal applied and the selection signals results in an output being provided to switch SW1 to provide the selected voltage level. In a similar manner, the output from Amplifier R is provided on line 274-23 to Variable Impedance B 274-20, and with control signals on line 274-24, results in the selected voltage signals being applied to switch SW2.

Switches SW1 and SW2 are analog switches and are essentially single pole double throw switches that are switched under control of signals provided on line 274-25. When the selection is to program the left hearing aid, switch SW1 will be in the position shown and the output signals from Variable Impedance A will be provided on line 278-1 to LF hearing aid. At the same time, the output from Variable Impedance B 274-20 will be provided through switch SW2 to line 278-2. When it is determined that the Right hearing aid is to be programmed, the control signals on line 274-25 will cause switches SW1 and SW2 to switch. This will result in the signal from Variable Impedance A to be provided on line 274-1, and the output from Variable Impedance B to be provided on line 274-2 to the Right hearing aid.

With the circuit elements shown, the program that resides in Program Memory 272 in conjunction with the control of Microprocessor 260 will result in application of data and control signals that will read information from Left and Right hearing aids, and will cause generation of the selection of application and the determination of levels of analog voltage signals that will be applied selectively the Left and Right hearing aids.

In another embodiment of the present subject matter, a Portable Multiprogram Unit (PMU) is adapted to store one or more hearing aid adjusting programs for a patient or user to easily adjust or program hearing aid parameters. The programs reflect adjustments to hearing aid parameters for various ambient hearing conditions. Once the PMU is programmed with the downloaded hearing aid programs, the PMU utilizes a wireless transmission to the user's hearing aid permitting the selective downloading of a selected one of the hearing aid programs to the digitally programmable hearing aids of a user.

Figure 8:
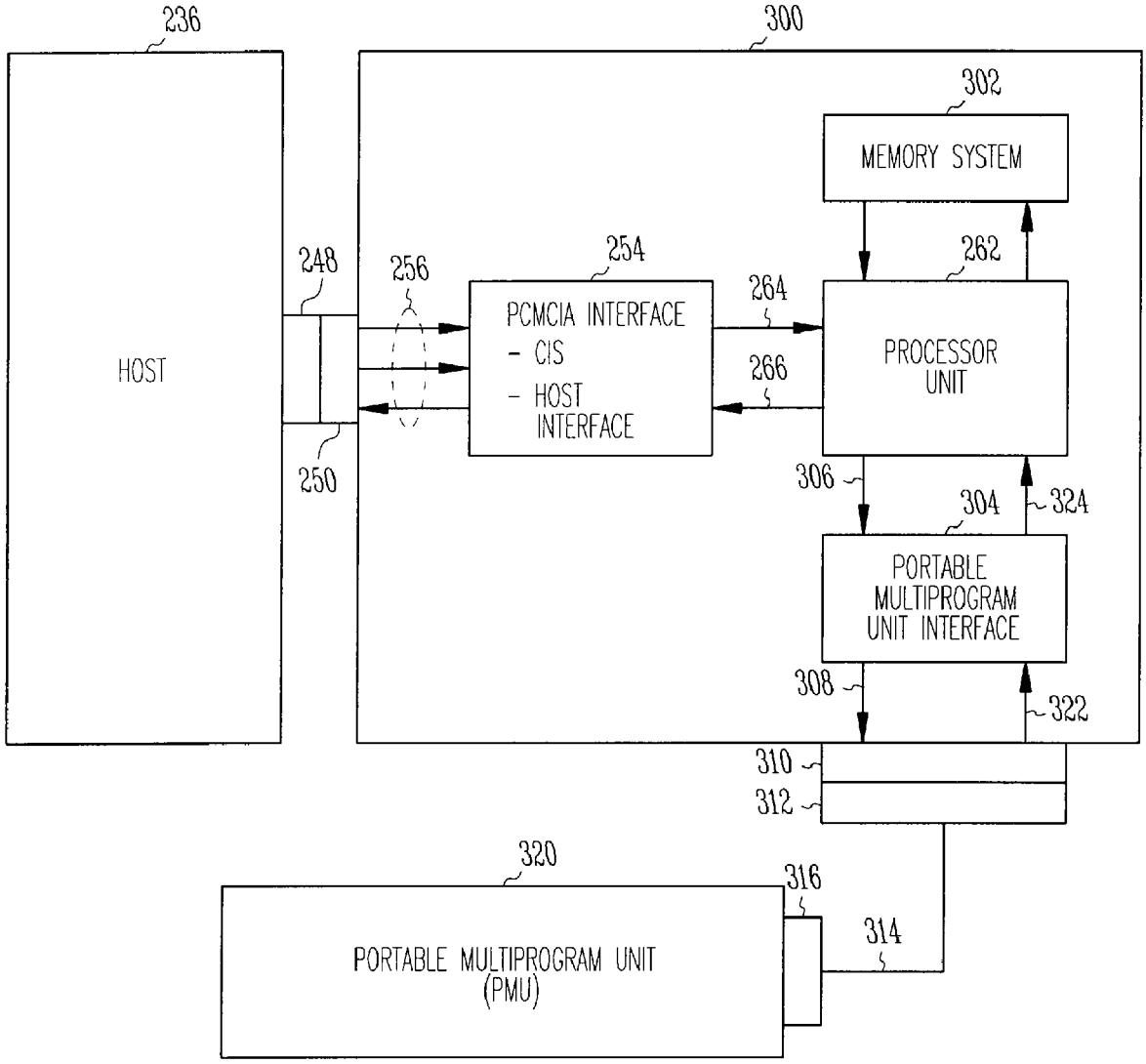
FIG. 8 is a block diagram illustrating the functional relationship of the host computer and the Card used to program a portable multiprogram unit, in one embodiment of the present subject matter.

FIG. 8 is a block diagram illustrating the functional relationship of the host computer and the Card used to program a portable multiprogram unit. The PCMCIA Card 300 is coupled via connector portions 250 and 248 to Host 236. This PCMCIA interconnection is similar to that described above. The Host 236 stores one or more programs for programming the hearing aids of a patient. The Host can be any portable processor of the type described above, and advantageously can be a Message Pad 2000 hand-held computer. The hearing aid programmer Card 300 has a PCMCIA Interface 254 that is coupled to host 236 via conductors 256 through the PCMCIA connector interface 248 and 250. A Processor Unit 262 is schematically coupled via conductor paths 264 and 266 to the PCMCIA Interface 254 for bidirectional flow of data and control signals. A Memory System 302 can include nonvolatile memory and volatile memory for the boot-strap and program storage functions described above.

A Portable Multiprogram Unit Interface 304 receives hearing aid programs via line 306 from the Processor Unit 262 and provides the digital hearing aid programs as signals on line 308 to jack 310. Connector 312 mates with jack 310 and provides the hearing aid program signals via cable 314 to removable jack 316 that is coupled to the Portable Multiprogram Unit 320. Control signals are fed from PMU 320 through cable 314 to be passed on line 322 to the Portable Multiprogram Unit Interface 304. These control signals are in turn passed on line 324 to the Processor Unit 262, and are utilized to control downloading of the hearing aid programs. PMUs are available commercially, and will be only functionally described.

This embodiment differs from the embodiment described with regard to FIG. 6 in that there is not direct electrical connection to the hearing aids to be programmed. It should be understood that the portable multiprogram unit interface and its related jack 310 could also be added to the PCMCIA Card illustrated in FIG. 6 and FIG. 7, thereby providing direct and remote portable hearing programming capability on a single Card.

In this embodiment, the functioning of the PCMCIA Interface 254 is similar to that described above. Upon plugging in PCMCIA Card 300, the Host 236 responds to the CIS and its Card identification for the selected hearing aid programming function. At the same time, Processor Unit 262 has power applied and boot-straps the processor operation. When thus activated, the Card 300 is conditioned to receive one or more selected hearing aid programs from the Host. Selection of hearing aid program parameters is accomplished by the operator selection of parameters for various selected conditions to be applied for the particular patient.

The number of programs for a particular patient for the various ambient and environmental hearing conditions can be selected, and in a preferred embodiment, will allow for four distinct programming selections. It is, of course, understood that by adjustment of the amount of storage available in the hearing aids and the PMU, a larger number of programs could be stored for portable application.

Figure 9:
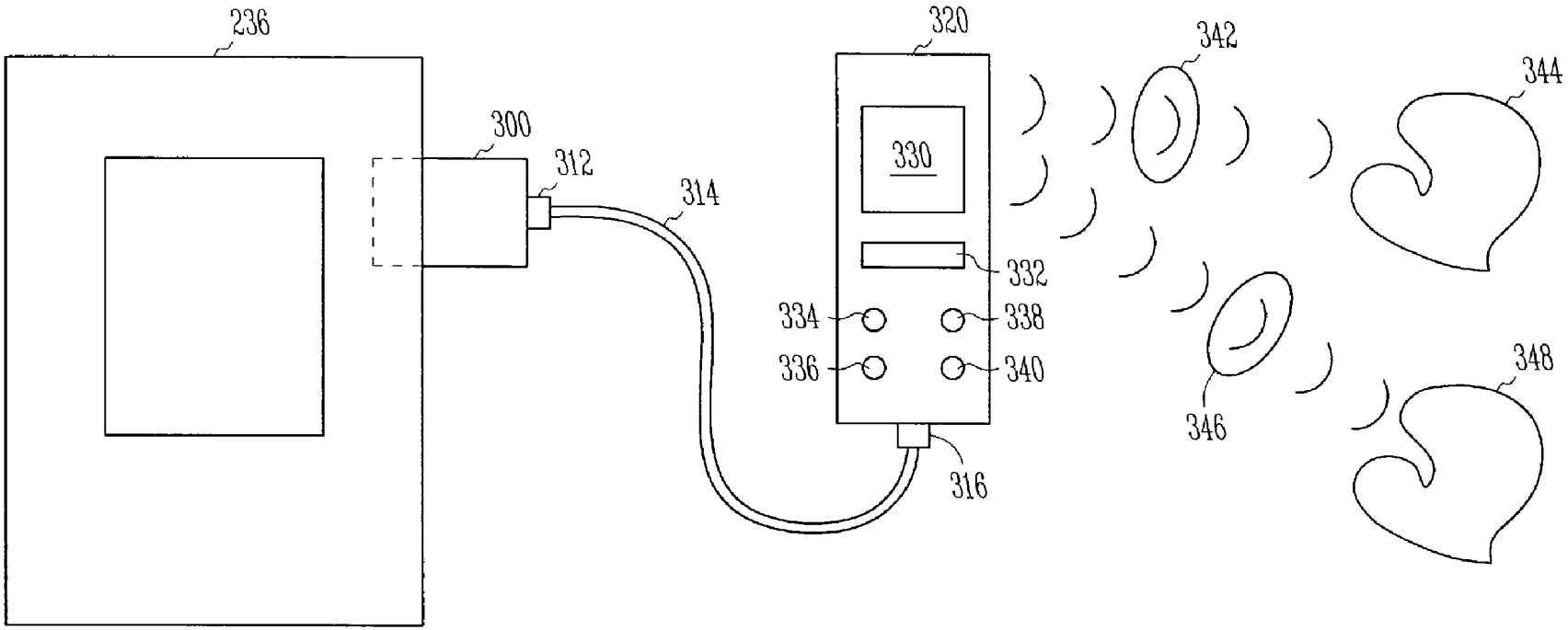
FIG. 9 is a functional diagram illustrating selective control programming of hearing aids utilizing a portable multiprogram unit, in one embodiment of the present subject matter.

FIG. 9 is a functional diagram illustrating selective controlled programming of hearing aids utilizing a portable multiprogram unit. As shown, a host 236 has PCMCIA Card 300 installed therein, and intercoupled via cable 314 to the Portable Multiprogram Unit 320. The PMU is a programmable transmitter of a type available commercially and has a liquid crystal display (LCD) 330, a set of controls 332 for controlling the functionality of the PMU, and program select buttons 334, 336, 338 and 340. The operational controls 332 are utilized to control the state of PMU 320 to receive hearing aid program signals for storage via line 314, and to select the right or left ear control when transmitting. The programs are stored in Electrically Erasable Programmable Read Only Memory (EEPROM) and in this configuration will hold up to four different programming selections.

The PMU 320 can be disconnected from cable 314 and carried with the patient once the hearing aid programs are downloaded from the Host 236 and stored in the PMU.

The PMU 320 includes circuitry and is self-powered for selectively transmitting hearing aid program information via a wireless link 342 to a hearing aid 344, and via wireless transmission 346 to hearing aid 348.

The hearing aids 344 and 348 for a user are available commercially and each include EEPROM storage for storing the selected then-active hearing aid program information. This arrangement will be described in more detail below.

The wireless link 342 and 346 can be an infrared link transmission, radio frequency transmission, or ultrasonic transmission systems. It is necessary only to adapt the wireless transmission of PMU 320 to the appropriate program signal receivers in hearing aids 344 and 348.

Figure 10:
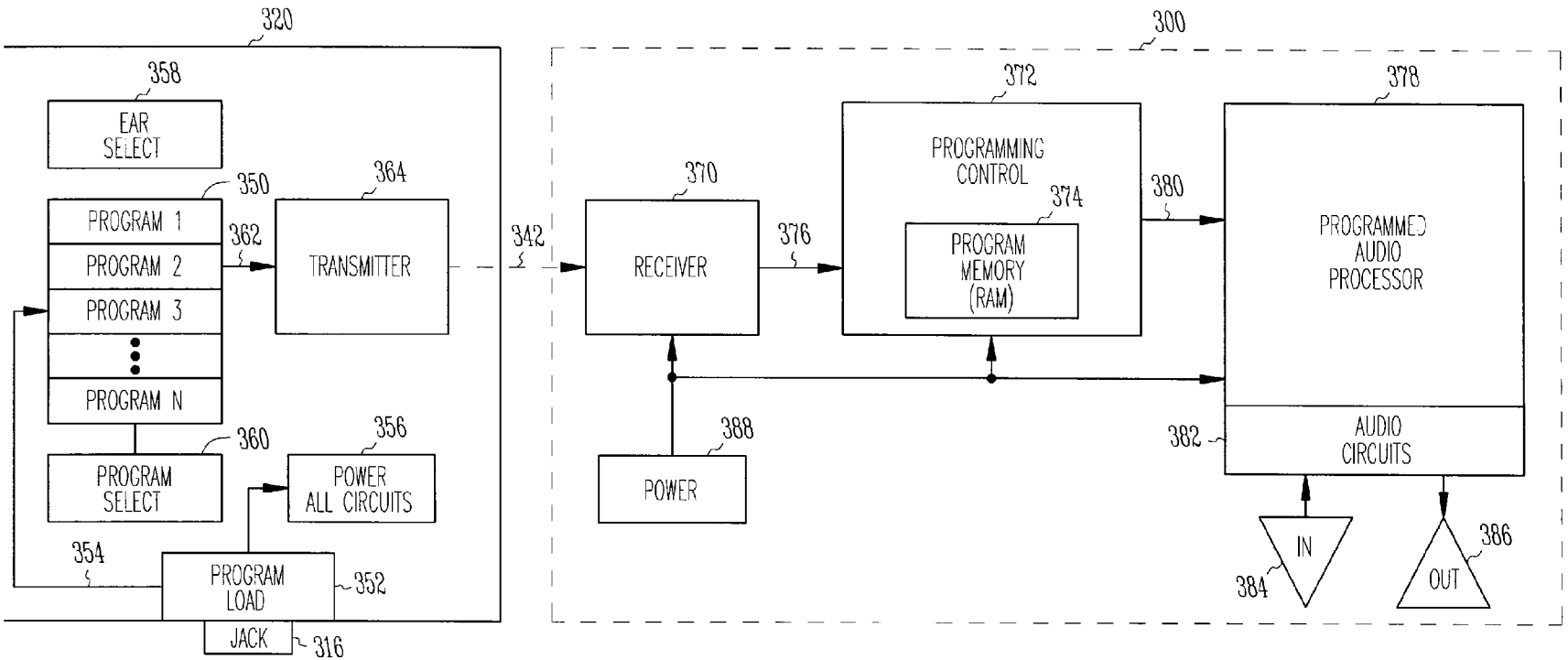
FIG. 10 is a function block diagram of the portable multiprogram unit programming a hearing aid, in one embodiment of the present subject matter.

FIG. 10 is a functional block diagram of the portable multiprogram unit programming a hearing aid. The PMU 320 is shown communicating to a hearing aid shown within dashed block 300, with wireless communications beamed via wireless link 342. As illustrated, an EEPROM 350 is adapted to receive and store hearing aid programs identified as PROGRAM 1 through PROGRAM N. The Program Load block 352 is coupled to jack 316 and receives the download hearing aid programs for storing via line 354 in the memory 350. The PMU contains its own power source and Power All Circuits 356 applies power when selected for loading the programs to erase the EEPROM 350 and render it initialized to receive the programs being loaded. Once loaded, the cable 314 (pictured in FIG. 9) can be disassembled from jack 316, and the PMU 320 is ready for portable programming of hearing aid 344.

To accomplish programming of a hearing aid, the Ear Select 358 of the controls 332 (see FIG. 9), is utilized to determine which hearing aid is to be programmed.

It will be recalled that it is common for the right and left hearing aids to be programmed with differing parameters, and the portions of the selected program applicable to each hearing aid must be selected.

Once the right or left ear hearing aid is selected, the Program Select 360, which includes selection controls 334, 336, 338 and 340 (pictured in FIG. 9), is activated to select one of the stored programs for transmission via line 362 to Transmitter 364. The patient is advised by the hearing professional which of the one or more selectable hearing aid programs suits certain ambient conditions. These programs are identified by respective ones at controls 334, 336, 338 and 340.

The hearing aid to be programmed is within block 300, and includes a receiver 370 that is responsive to transmitter 364 to receive the wireless transmission of the digital hearing aid program signals provided by PMU 320. A Programming Control 372 includes a Program Memory 374, which can be an addressable RAM. The digital signals received after Receiver 370 are provided on line 376 to the Programming Control 372 and are stored in the Program Memory 372. Once thus stored, the selected program remains in the Program Memory until being erased for storage of a next subsequent program to be stored.

The Program Audio Processor 378 utilizes the Programming Control 372 and the Program Memory 374 to supply the selected stored PROGRAM signals transmitted on-line 380 to adjust the parameters of the Audio Circuits 382 according to the digitally programmed parameters stored the Program Memory 374. Thus, sound received in the ear of the user at the Input 384 are processed by the Programmed Audio Circuits to provide the conditioned audio signals at Output 386 to the wearer of the hearing aid 344.

Power 388 is contained within the hearing aid 300 and provides the requisite power to all circuits and components of the hearing aid.

In operation, then, the user can reprogram the hearing aids using the PMU 320 to select from around the stored hearing aid programs, the one of the stored programs to adjust the programming of the user's hearing aids to accommodate an encountered ambient environmental hearing condition. Other ones of the downloaded stored programs in the PMU can be similarly selected to portably reprogram the hearing aids as the wearer encounters different ambient environmental conditions. Further, as hearing changes for the user, the PMU 320 can be again electrically attached to the PCMCIA Card 300 and the hearing aid programs adjusted by the hearing professional using the Host 236, and can be again downloaded to reestablish new programs within the PMU 320.

In various embodiments of the present subject matter, host computers are adapted to support communication with a hearing aid programmer which is capable of programming hearing aids. In various embodiments, a wireless interface is adapted to connect to the hearing aid programmer, and to communicate with one or more hearing aids wirelessly. In various embodiments, the systems of the present subject matter provides an inexpensive portable hearing aid programming system which can easily be adapted to program a variety of hearing aids by loading various data. Additionally, by including adaptations compatible with the NOAHlink™ hearing aid programmer, the system cost can be reduced, as standardized hearing aid programmers can be less expensive than custom designed hearing aid programmers. One benefit of the present subject matter is improved portability. The hearing aid programming system, in various embodiments, provides a solution for programming hearing aids which does not require the use of cables or wires for data communication.

Figure 11:
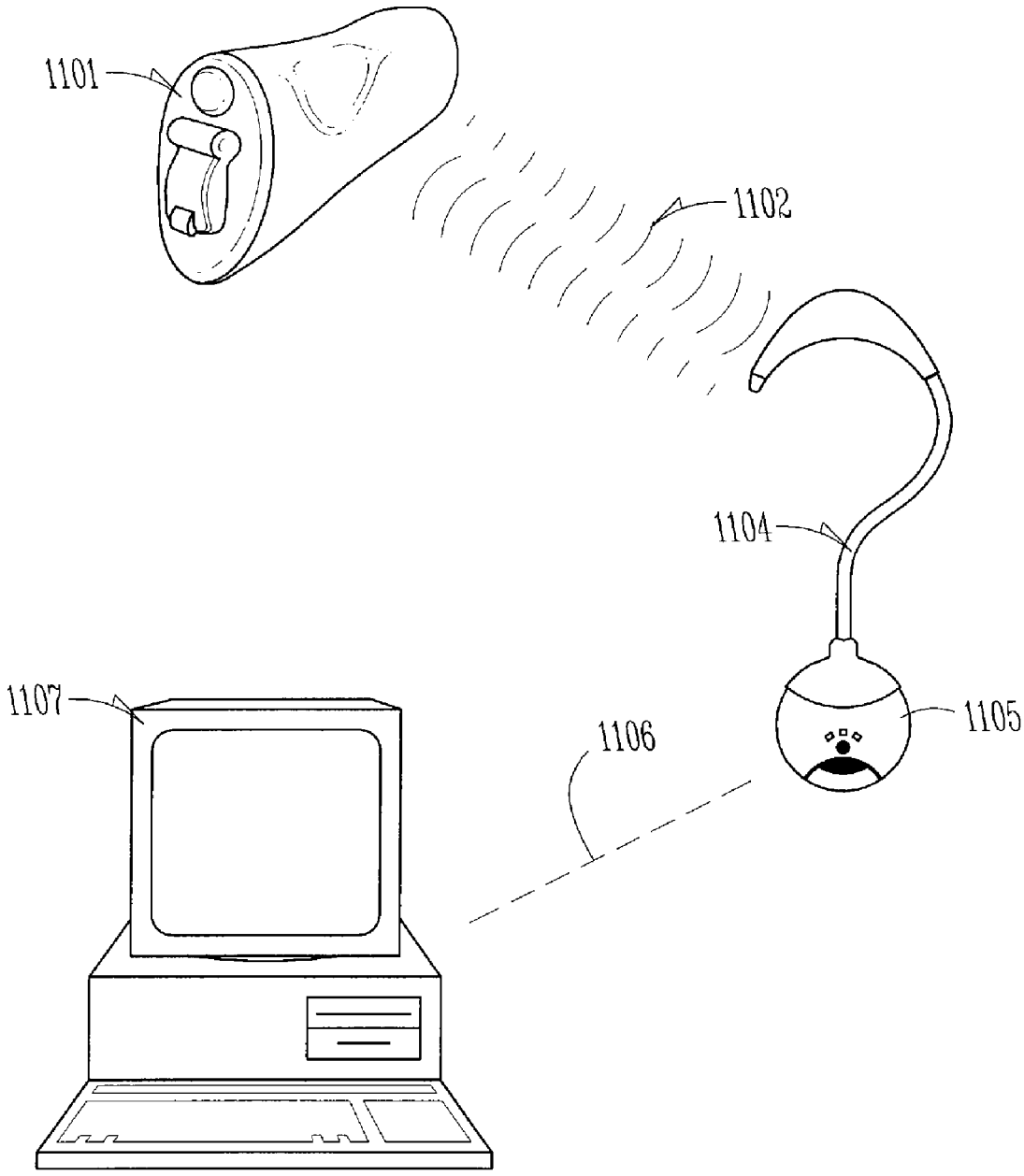
FIG. 11 illustrates one embodiment of a portable hearing aid programming system according to one embodiment of the present subject matter.

FIG. 11 illustrates one embodiment of a portable hearing aid programming system according to various aspects of the present subject matter. In various embodiments, the system includes a host computer system 1107 equipped to communicate data wirelessly 1106. Some embodiments wirelessly communicate data 1106 unidirectionally, and others wirelessly communicate data 1106 bidirectionally. In some examples, data is communicated to a hearing aid programmer 1105. In one example, the host computer is adapted to communicate in a manner compatible with a NOAHlink™ wireless hearing aid programmer.

Various examples include a hearing aid programmer 1105 which communicates wirelessly 1106 with the host computer 1107 using a protocol adapted to be compatible with the Bluetooth™ wireless communication system. The Bluetooth™ wireless communication system operates on an unlicensed 2.4 GHz Industrial, Scientific and Medical (ISM) band. Devices adapted for compatibility with the communication system are capable of providing real-time audio-video and data communication. Copyrights to the Bluetooth™ wireless communication system specification are owned by the Promoter Members of Bluetooth SIG, Inc. The scope of the present subject matter includes wireless communications adapted to be compatible with the Bluetooth™ Specification, specifically, at least v1.2, available at http://www.bluetooth.com (last visited Jan. 26, 2004).

In various embodiments, a wireless interface 1104 is adapted to connect to the hearing aid programmer 1105. In some examples, the wireless interface receives data from the connected hearing aid programmer and wirelessly communicates 1102 it to hearing aids 1101. In one example, the wireless communications occur over a radio frequency of approximately 3.84 Megahertz.

Figure 12A:
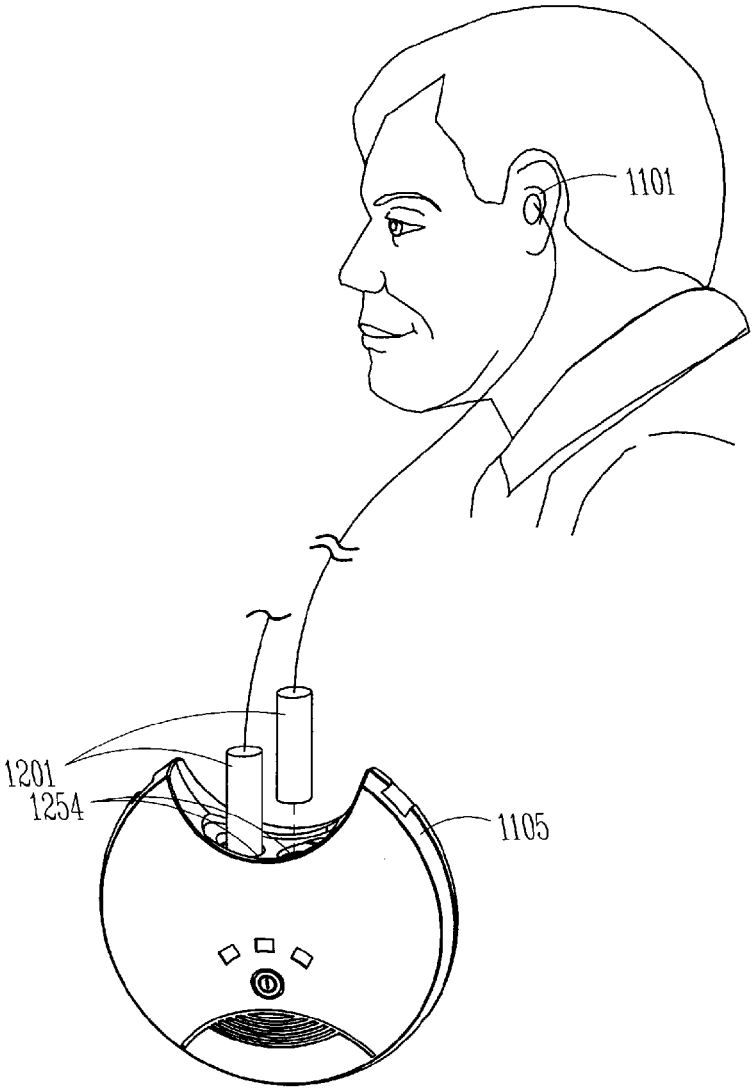
FIG. 12A illustrates one embodiment of a hearing aid programmer for communication with a host computer, in various embodiments of the present subject matter.

FIG. 12A illustrates an embodiment of a hearing aid programmer for communication with a host computer, in various embodiments of the present subject matter. In various embodiments, the hearing aid programming system is compatible with a NOAHlink™ hearing aid programmer. In one example, the NOAHlink™ hearing aid programmer communicates with a host computer in a manner compatible with the Bluetooth™ wireless communication system. In various examples, the hearing aid programmer 1105 is adapted for a wired connection to a hearing aid using a cable connector 1201. In one embodiment, the connector 1254 connects using a 6-pin mini-DIN connection system.

Figure 12B:
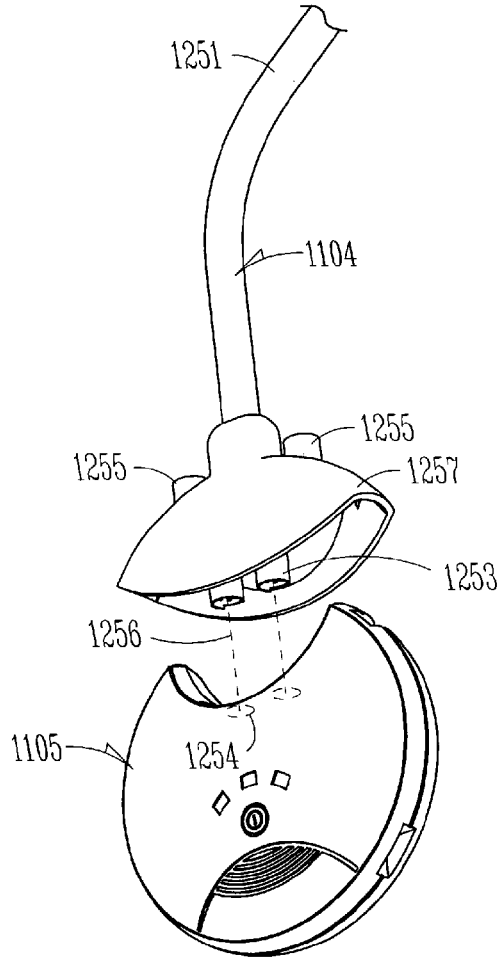
FIG. 12B illustrates one embodiment of a hearing aid programmer which communicates with a host computer in various embodiments of the present subject matter.

FIG. 12B illustrates one embodiment of a wireless interface adapted to connect to a hearing aid programmer 1105, in various embodiments of the present subject matter. In various embodiments, a hearing aid programmer 1105 includes a connector 1254. The present subject matter includes a wireless interface 1104 adapted to connect 1256 to the hearing aid programmer 1105. In one example, both the connector 1254 and the connector 1256 interface using a 6-pin mini-DIN connection system. It should be understood, however, that the scope of the present subject matter should not be limited to the connections described here.

Further embodiments of the wireless interface 1104 include an output connector 1255 adapted for connecting hearing aids. For example, the output connector 1255 can form a cable connection 1201 (pictured in FIG. 12A) for programming a hearing aid 1101 while the wireless interface 1104 is connected to the hearing aid programmer 1105. In one embodiment, the connector 1255 utilizes a 6-pin mini-DIN connection system. Another embodiment encases the connector 1255 in a shroud 1257, which is adapted for mechanical connection compatible with a NOAHlink™ hearing aid programmer.

In various embodiments, the shroud 1257 adds various functions to the hearing aid programming system. For example, in some embodiments, the shroud 1257 helps align the hearing aid programmer 1105 with the wireless interface 1104 while the two are being connected. In varying embodiments, the shroud 1257 also provides a graspable surface to facilitate an individual to connect the hearing aid programmer 1105 to the wireless interface 1104. Varying embodiments also provide a fastening means, such as a lock or hook, to attach the hearing aid programmer 1105 to the wireless interface 1104. A lock helps to ensure that the hearing aid programmer does not become disconnected from the wireless interface 1104 during use. Additionally, in some examples, the shroud 1257 also provides a space for the installation of electronics. Overall, the shroud provides a range of functions, and those listed here are not representative of the entire scope of the shroud 1257 functionality.

Additional embodiments of the wireless interface 1104 include an interconnecting conduit 1251 which may be shaped for hanging. In some examples, the wireless interface 1104 may hang from an individual's neck.

Figure 13:
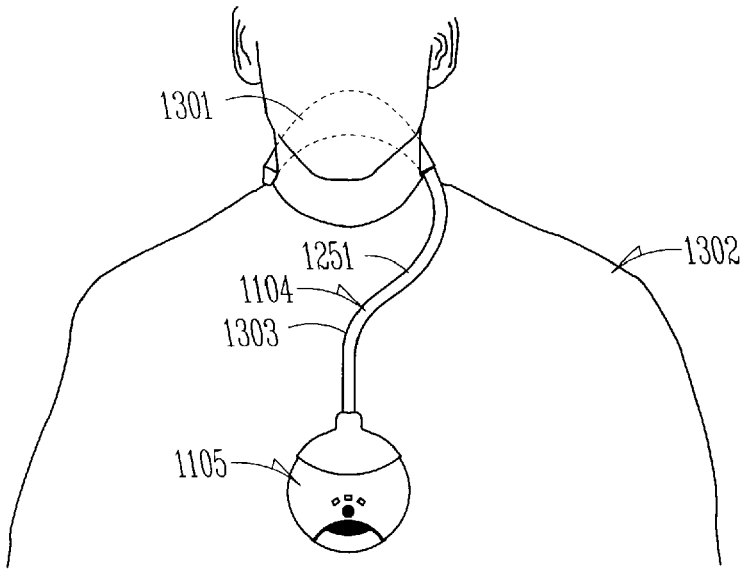
FIG. 13 illustrates various embodiment of a hearing aid programmer connected to a wireless interface in various embodiments of the present subject matter.

FIG. 13 illustrates a hearing aid programmer 1105 connected to a wireless interface 1104 in various embodiments of the present subject matter. In various examples, the wireless interface 1104 includes a housing 1301 for wireless electronics. Additionally, in some examples, the wireless interface 1104 includes an interconnecting conduit 1251. In one embodiment, the interconnecting conduit is shaped so that the portable hearing aid programming system may hang from an individual's neck, however, the scope of the present subject matter should not be understood as limited to such embodiments. In one example, the wireless interface facilitates the hanging of the portable hearing aid programming system on an individual 1302 such that the hearing aid programmer 1105 is located proximate to the individual's chest. In further embodiments, the wireless interface facilitates the hanging of the portable hearing aid programming system on an individual 1302 such that the housing for wireless electronics 1301 is located behind the individual's neck. It should be noted that the hearing aid programming system may accomplish its goals when hanging on an individual during programming, but it may also accomplish its goals when not physically hanging on an individual.

Figure 14:
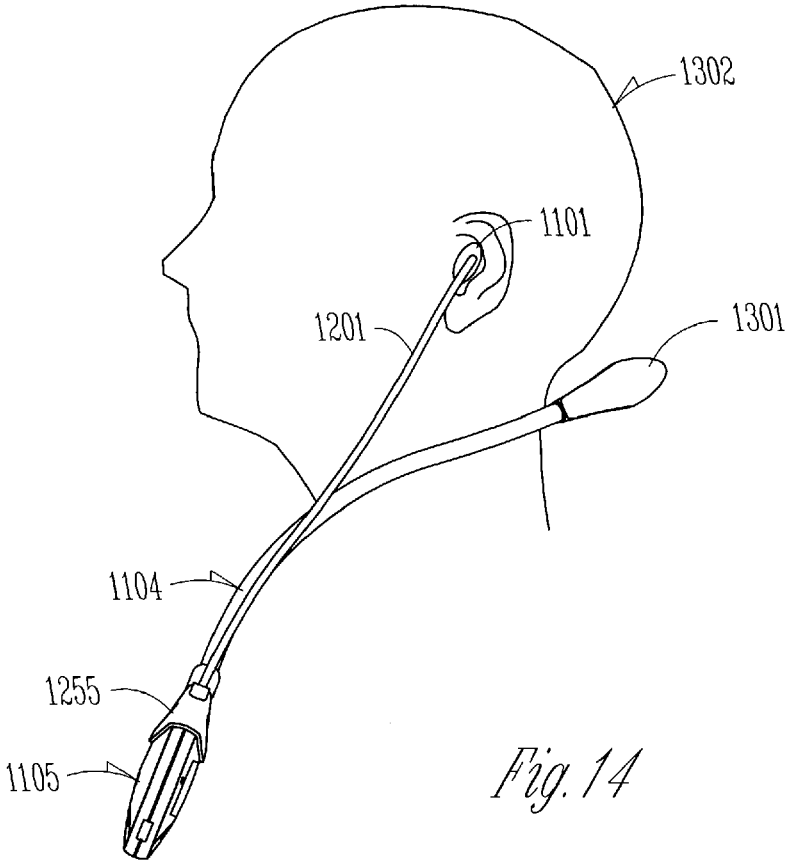
FIG. 14 illustrates a side view of one embodiment of the present subject matter in which an individual wears a hearing aid programmer connected to a wireless interface.

FIG. 14 illustrates a side view of one embodiment of the present subject matter in which an individual 1302 wears a portable hearing aid programming system. In various embodiments, the hearing aid programmer 1105 programs at least one hearing aid 1101 by communicating data over at least one cable connection 1201. In various embodiments, the cable connection 1201 is connected to output connector 1255. In some examples, the cable connection 1201 is connected to hearing aids 1101. In further examples, the wireless interface 1104 communicates with the hearing aid 1101 exclusively through the connectors 1255 and the cable connection 1201. In other examples, the wireless interface 1104 communicates with the hearings aids 1101 both wirelessly and using cable communications. It should be understood that the scope of the present subject matter includes embodiments adapted to hang on a user as illustrated in FIG. 14, but also includes embodiments which hang differently, or do not hang at all.

In various embodiments, the wireless interface 1104 includes a housing for wireless electronics 1301. In various embodiments, the wireless interface 1104 facilitates the hanging of the portable hearing aid programming system on the individual 1302 such that the housing for wireless electronics 1301 is positioned behind the individual's neck, proximal to the hearing aids 1101. In further embodiments, the wireless interface 1104 facilitates the hanging of the portable hearing aid programming system on the individual 1302 such that the hearing aid programmer 1105 is positioned proximate to the individual's chest.

Figure 15:
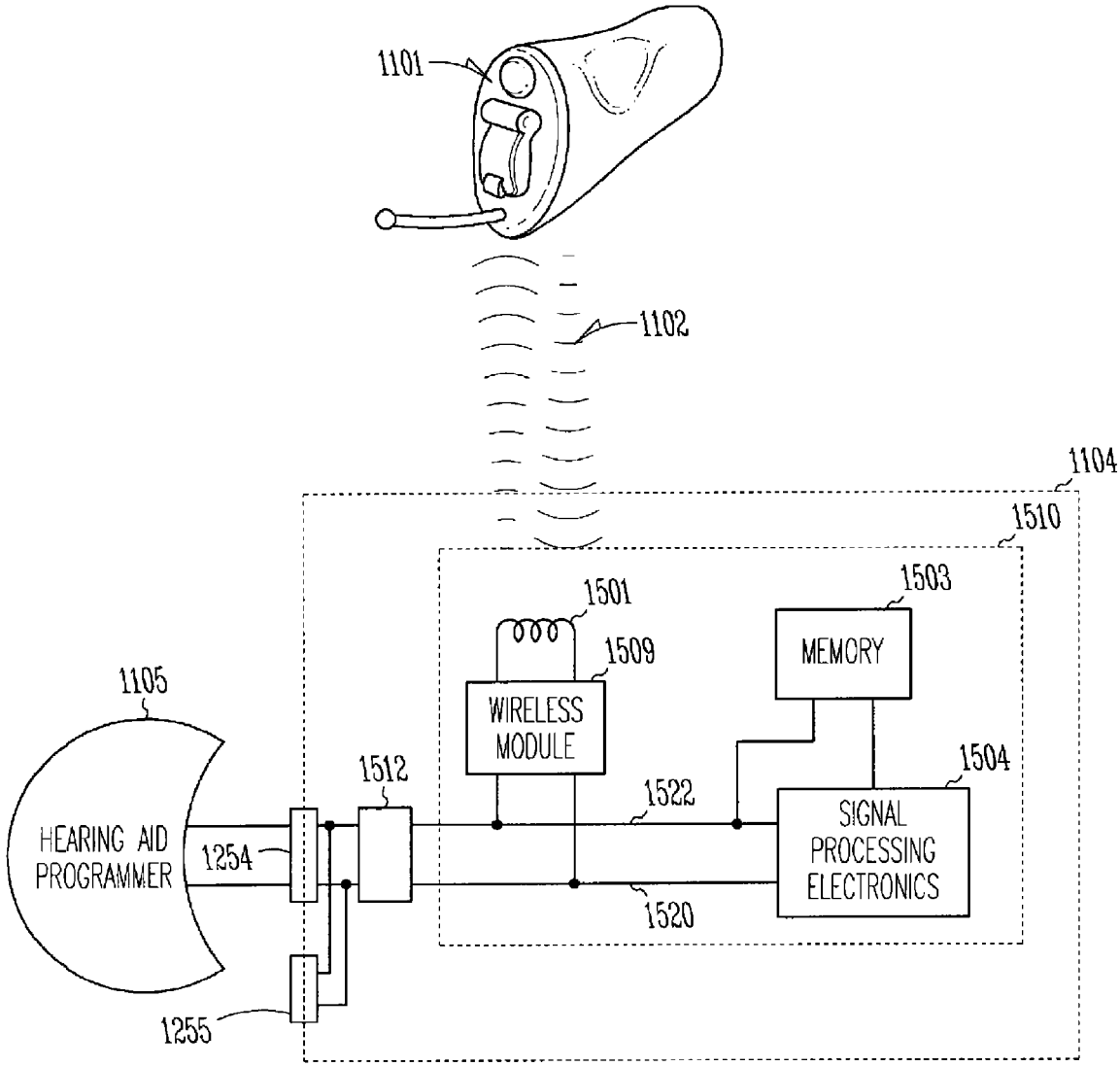
FIG. 15 illustrates a portable system for programming hearing aids according to one embodiment of the present subject matter.

FIG. 15 illustrates a portable system for programming hearing aids according to one embodiment of the present subject matter. Wireless interface 1104 includes one or more features of the wireless interface 1104 illustrated in FIGS. 12A-12B. Thus, the present discussion will omit some details which are referred to above regarding FIGS. 12A-12B. In various embodiments, the wireless interface 1104 connects with a hearing aid programmer 1105 through a connector 1254. In various embodiments of the present subject matter, an output connector 1255 is connected to the connector 1253, which is mated to connector 1254. This output connector serves as a connection point for wired devices, such as hearing aids.

In one embodiment, the wireless interface 1104 is comprised of wireless electronics 1510 and over voltage protection 1512. Over voltage protection 1512 is connected between the hearing aid programmer 1105 and the wireless electronics 1510, as discussed below. In one embodiment, the wireless electronics 1510 are integrated onto a hybrid chip.

In some embodiments, data for programming the wireless interface is communicated with the hearing aid programmer 1105. In various embodiments, the wireless interface 1105 uses signal processing electronics 1504 which communicate data with the hearing aid programmer 1105. In various embodiments, the signal processing electronics 1504 boot a wireless module 1509, which initiates wireless data communication 1102 to hearing aids 1101. Other embodiments do not require repeated booting, as wireless functioning 1102 is continuous. In some examples, the function of the signal processing electronics is performed by a digital signal processor.

Some embodiment use signal processing electronics 1504 which perform various functions in addition to booting the wireless module 1509. In one example, the controller 1504 performs signal processing on data. The signal processing may be analog or digital. Some examples include signal processing, amplification and other function performed to meet the needs of an individual hearing aid user. In various examples, data produced through signal processing can be later communicated to other components in the wireless interface 1104 for use or storage. Additionally, in some examples of the present subject matter, the signal processing electronics use a memory 1503 which is a permanent memory, such as an EEPROM. Various examples of the present subject matter utilize the memory 1503 to store programs or data which is later used by the signal processing electronics, or communicated to other components.

Power for the components in the wireless interface 1104, in various embodiments, is supplied by the hearing aid programmer 1105 by at least one conduction path 1522. As pictured, one embodiment uses power from the hearing aid programmer 1105 to power wireless module 1509, the signal processing electronics 1504, and the memory 1503. However, it should be noted that other embodiments include designs which obtain power from other sources, such as batteries. Additionally, in various embodiments, only some of the hearing aid components are powered by the hearing aid programmer 1105. Further, it should be noted that in various embodiments, the hearing aid programmer 1105 can control the supply of power 1522 to power on or power off various components connected to the power line 1522.

In various embodiments, the wireless interface 1104 includes a wireless module 1509. In various embodiments, the wireless module 1509 is an integrated circuit. One example uses a wireless module 1509 connected to an antenna 1501. Various embodiments of the present subject matter communicate wirelessly 1102 using radio waves. In one example, the wireless communicator 1509 communicates with programmable hearing aids 1101 using a radio frequency of approximately 3.84 Megahertz. Varying examples use a wireless communication protocol suitable to transport application data, parameters, content, or other information.

Various examples of the present subject matter use the wireless communicator 1509 to communicate data with other components in the wireless interface 1104. In one embodiment, the wireless communicator 1509 communicates data with the signal processing electronics 1504. Other embodiments communicate data to the memory 1503. In one embodiment, the wireless communicator 1509 communicates data to the hearing aid programmer 1105.

One embodiment of the present subject matter includes a communication bus which carries data according to a communication protocol. Varying communication protocols can be employed. One exemplary protocol both requires fewer signal carrying conductors and consumes lower power. Varying communication protocols include operation parameters, applications, content, and other data which may be used by components connected to a communication bus 1520. In one embodiment, the wireless communicator 1509 and signal processing electronics 1504 are connected to the communication bus 1520 and transmit and receive data using the communication bus 1520.

In various embodiments, the wireless interface 1104 includes components which enable the wireless interface 1104 to communicate with a programmable hearing aid 1101 using a streaming digital signal. In various embodiments, streaming digital data includes operational parameters, applications, and other data which is used by components. In one embodiment, compressed digital audio data is communicated to the hearing aids for diagnostic purposes. Additionally, in varying embodiments, digital streaming data communication is bidirectional, and in some embodiments it is unidirectional. One example of bidirectional communication includes the transmission of data which indicates the transmission integrity of the digital streaming signal, which, in some embodiments, allows for signal tuning. It should be noted that the data transferred to the hearing aids is not limited to data used for programming devices, and could contain other information in various embodiments.

Figure 16:
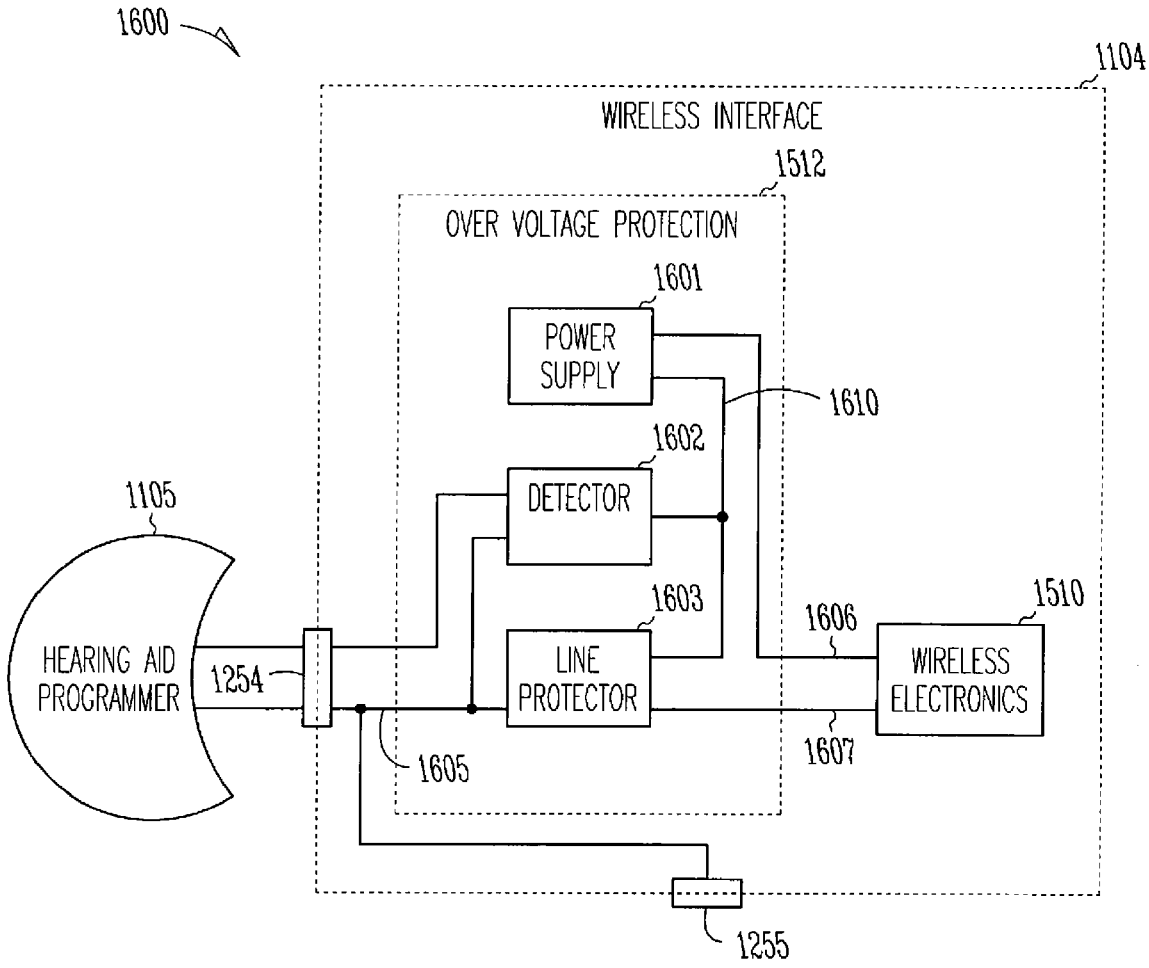
FIG. 16 illustrates one embodiments of electronics used for over-voltage protection, in one embodiment of the present subject matter.

FIG. 16 illustrates one embodiment of electronics used for over-voltage protection. In various embodiments, the wireless interface 1104 includes over-voltage protection 1512. Varying embodiments benefit from over-voltage protection because some hearing-aid programming signals which pass through the wireless interface 1104 occur at voltage levels which could damage various electronics in the wireless interface 1104. In some examples, a programming protocol incompatibility could also introduce damaging levels of electricity. Over-voltage protection 1512, in various embodiments, includes electronics which measure a voltage 1610 occurring between the wireless interface 1104 and the hearing aid programmer 1105. In one example, the over voltage protection 1512 monitors the voltage occurring on at least one hearing aid programmer circuit 1605 connected to the wireless interface 1104.

In various embodiments, the wireless interface 1510 is powered by electricity supplied by the hearing aid programmer 1105. In one example, the over-voltage protection can compare the measured voltage in the at least one hearing aid programmer circuit 1605 to a threshold voltage. In further examples, if the measured voltage exceeds a threshold voltage limit, the over voltage protection enables the wireless interface 1104 to communicate wirelessly. Further examples do not enable the wireless interface 1104 to begin communicating wirelessly if the measured voltage does not exceed a threshold voltage limit.

In various embodiments, the over-voltage protection 1512, in response to a measured voltage 1605, electrically decouples the wireless electronics 1510 from the at least one hearing aid programmer circuit 1605. One benefit of decoupling the wireless electronics 1510 from the at lease one hearing aid programmer circuit 1605 is a decrease in the potential for damage due to excessive voltage.

Another benefit of over voltage protection is that the wireless electronics can be disabled while the output connector 1255 is connected to and programming hearing aids. Disabling the wireless electronics 1510 can conserve power in the hearing aid programmer 1105.

In various embodiments, the over voltage protection includes a detector 1602. In various embodiments, the detector 1602 monitors voltage on at least one hearing aid programmer circuit 1605. In various embodiments, the detector 1602 compares the measured voltage to a threshold voltage, and controls either or both of a power supply 1601 and a line protector 1603, using a communication line 1610. In various embodiments, the communication line 1610 carries communication using a standard communication protocol. In other embodiments, the communication occurs through point to point connections, not shown, which are switched to communicate information.

Control of a line protector, in various embodiments, includes opening the circuit between the wireless electronics 1510 and both the output connector 1255 and the hearing aid programmer 1105. Additionally, in various embodiments, the power supply is the source of energy for the wireless electronics 1510. In embodiments where the power supply is an energy source for the wireless electronics 1510, the detector 1602 can disable the supply of power to the wireless electronics 1510.

One benefit of the detector 1602 controlling wireless electronics 1510 is that the wireless electronics can be disabled while the output connector 1255 is connected to and programming hearing aids. Disabling the wireless electronics 1510 can conserve power in the hearing aid programmer 1105.

In various embodiments, the line protector 1603 does not require control inputs from a detector 1602, and instead measures voltage, and opens switches which electrically decouple the wireless electronics 1510 from power available from the hearing aid protector on a power circuit 1605.

In other embodiments, an analog or digital signal is conditioned and allowed to pass from line 1605 through line 1607 to the wireless electronics 1510. In varying embodiments, a signal carried on line 1607 originates in the hearing aid programmer 1105, and indicates to the wireless electronics 1510 to switch the line protector 1603. Embodiments which do not monitor voltage offer, in some embodiments, improved flexibility, and some examples decrease the likelihood of damaging wired hearing aids which are inadvertently connected to the wireless interface 1104.

Figure 17:
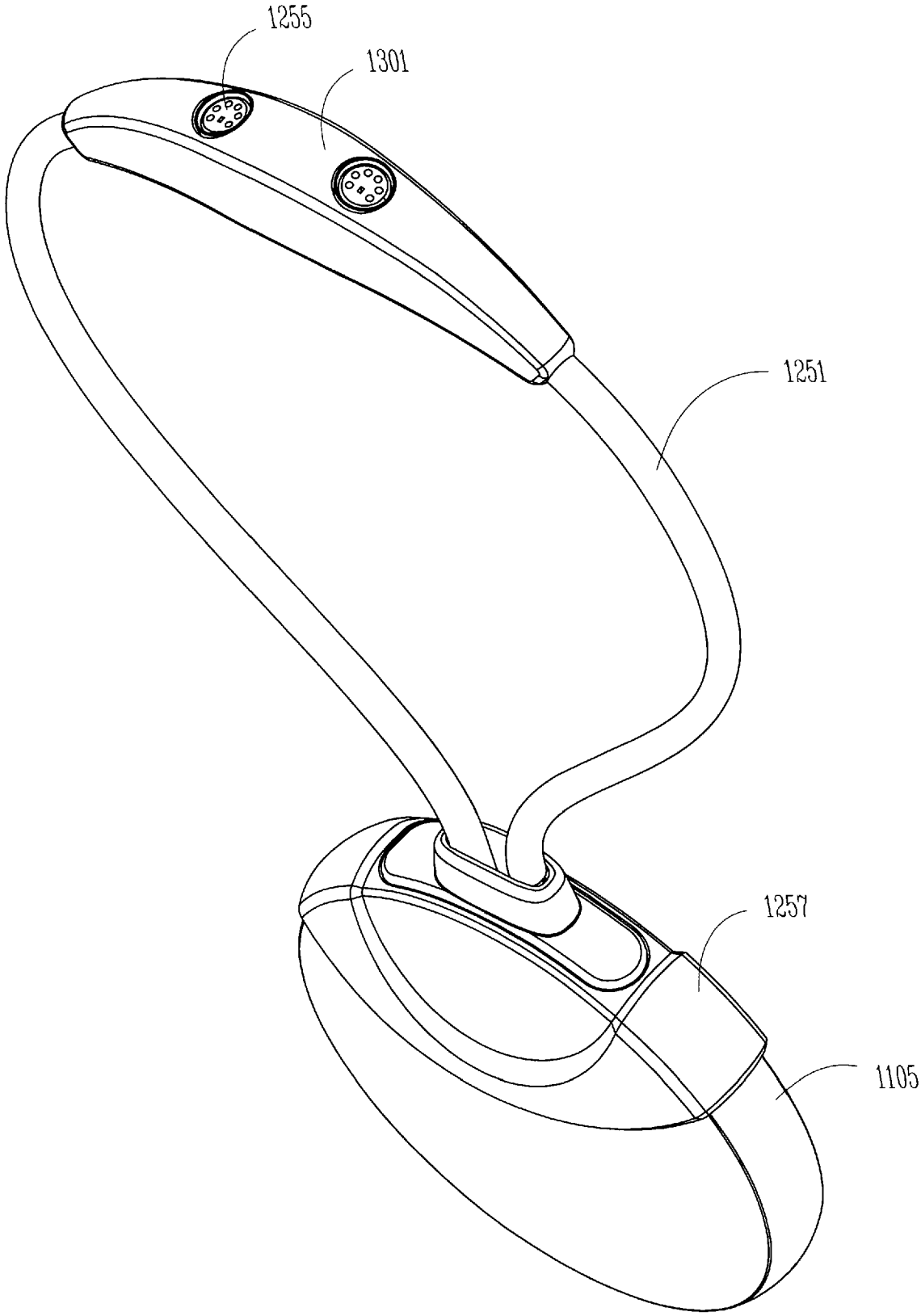
FIG. 17 discloses an embodiment of the wireless interface which uses a lanyard to hang on an individual's neck, in one embodiment of the present subject matter.

FIG. 17 discloses an embodiment of the wireless interface which uses a lanyard adapted to hang on an individual's neck. In various embodiments, the interconnecting conduit 1251 in comprised of a cord. In various embodiments, the cord is routed between a shroud 1257 which is adapted for making a mechanical connection compatible with a NOAHlink™ hearing aid programmer, and a housing 1301 for wireless electronics. In one embodiment, the wireless module is positioned in the housing, so that it is located near a hearing aid positioned in an ear canal. In various embodiments, the housing 1301 includes an output connector 1255 adapted for wired connection to hearing aids (not pictured). It should be noted that in various embodiments, the output connector may be located elsewhere on the wireless interface. In one example, the output connector 1255 is located in the shroud 1257.

Figure 18:
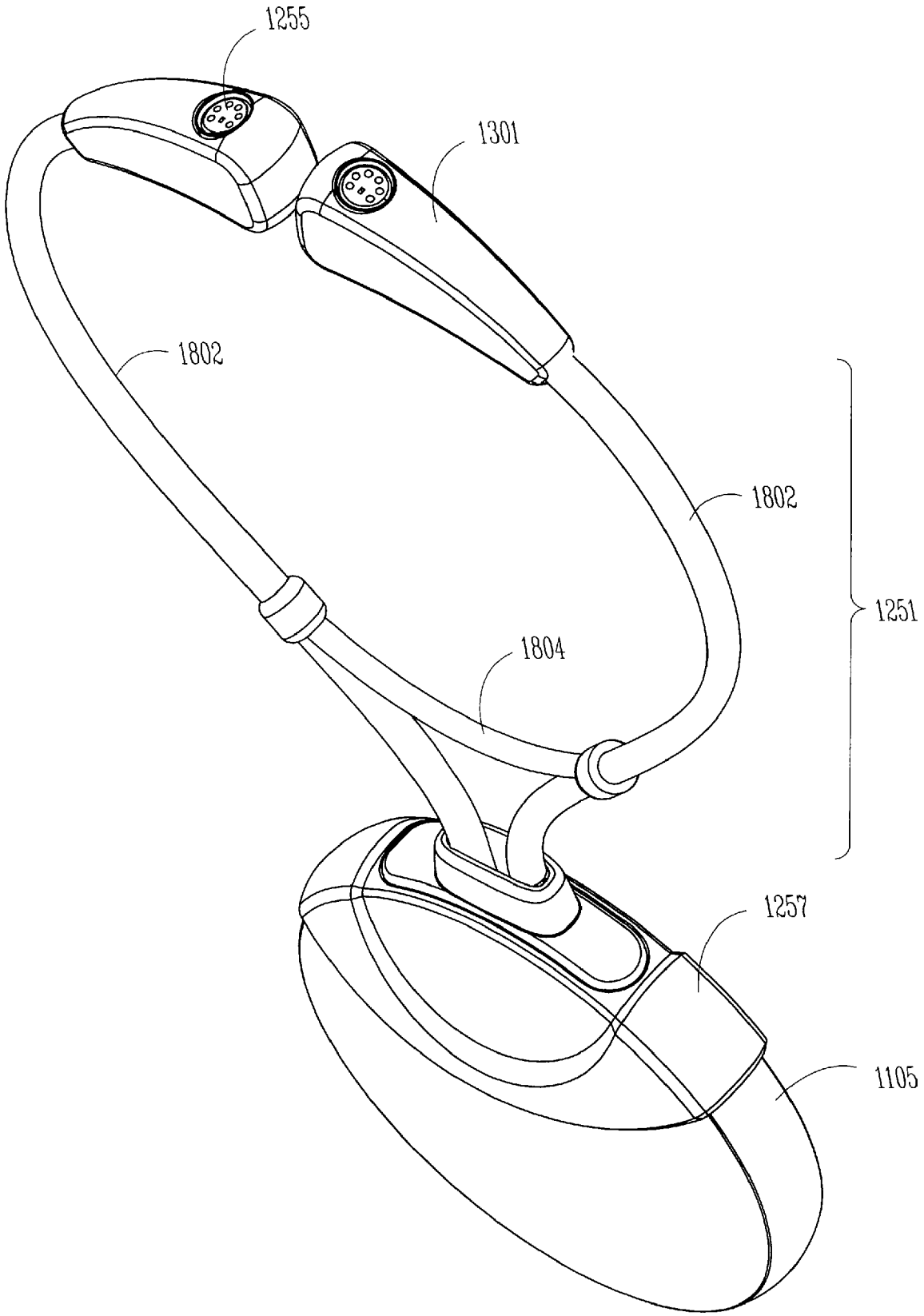
FIG. 18 discloses an embodiment of the wireless interface which uses a interconnecting conduit shaped like a stethoscope to hang on an individual's neck, in one embodiment of the present subject matter.

FIG. 18 discloses an embodiment of the wireless interface which uses a interconnecting conduit 1251 shaped like a stethoscope and adapted to hang on an individual's neck. In various embodiments, the interconnecting conduit 1251 is comprised of two semi-rigid members 1802. Various embodiments also include a springing tether 1804, which serves to hold the semi-rigid members 1802. It should be noted, however, that the tether is not necessary. In various embodiments, semi-rigid members may be deformed such that the wireless interface is adapted to be hung on an individual's neck.

In various embodiments, the cord is routed between a shroud 1257 which is adapted for making a mechanical connection compatible with a NOAHlink™, and a housing 1301 for wireless electronics. In one embodiment, the wireless module is located in the housing 1301, so that it is positioned near a hearing aid positioned in an ear canal.

In varying examples, benefits from positioning wireless electronics 1510 (pictured in FIG. 15 and others) in the housing 1301 rather than in shroud 1257 include a reduction in the potential for interference to the radio signal 1102 (pictured in FIG. 15 and others) and a reduction in the size of antennas and power requirements. In various embodiments, a reduction in antenna size and power requirements include the benefits of smaller hearing aids, longer battery life, smaller wireless interface size, and easier compliance with regulations which govern wireless communication due to a decrease in field strength. In some examples, a decrease in hearing aid size includes smaller battery size and smaller antenna size.

In various embodiments, the housing 1301 includes an output connector 1255 adapted for wired connection to hearing aids (not pictured). It should be noted that in various embodiments, the output connector may be located elsewhere on the wireless interface. In one example, the output connector 1255 is located in the shroud 1257.

One of ordinary skill in the art will understand that, the systems shown and described herein can be implemented using software, hardware, and combinations of software and hardware. As such, the term "system" is intended to encompass software implementations, hardware implementations, and software and hardware implementations.

In various embodiments, the methods provided above are implemented as a computer data signal embodied in a carrier wave or propagated signal, that represents a sequence of instructions which, when executed by a processor, cause the processor to perform the respective method. In various embodiments, methods provided above are implemented as a set of instructions contained on a computer-accessible medium capable of directing a processor to perform the respective method. In various embodiments, the medium is a magnetic medium, an electronic medium, or an optical medium.

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and other embodiments will be apparent to those of skill in the art upon reviewing the above description. The scope of the present subject matter should be determined with reference to the appended claims, along with the full scope of equivalents to which such claims are entitled.

What is claimed is:

1. A method for programming one or more hearing aids with a host computer, comprising:

wirelessly communicating with the host computer using a hearing aid programmer, the hearing aid programmer having at least one interface connector for communication with at least one hearing aid;

providing a wireless interface adapted for connecting to the at least one interface connector of the hearing aid programmer, and further adapted for wireless communication with one or more hearing aids, wherein the wireless interface comprises signal processing electronics, a memory and a wireless module; and providing at least one interconnecting conduit adapted for hanging the wireless interface on an individual's neck.

2. The method of claim 1, further comprising booting the wireless module using the signal processing electronics.

3. The method of claim 1, wherein providing the wireless interface including providing the wireless interface to communicate at a radio frequency of approximately 3.84 Megahertz.

4. The method of claim 1, wherein wirelessly communicating includes communicating using a protocol compatible with a Bluetooth™ standard.

5. The method of claim 4, wherein wirelessly communicating includes communicating using a protocol compatible with a NOAHlink™ communication protocol.

6. The method of claim 5, wherein providing a wireless interface includes providing an output connector for optional wired communication with hearing aids.

7. The method of claim 5, wherein the interface connector is adapted for making a mechanical connection compatible with the NOAHlink™ hearing aid programmer.

8. The method of claim 1, further comprising positioning the wireless module behind the individual's neck.

9. The method of claim 1, wherein providing the wireless interface is hook shaped and is adapted for hanging on an individual's neck.

10. The method of claim 8, wherein providing the wireless interface includes providing the wireless interface is shaped like a binaural stethoscope, comprising an interconnecting conduit adapted to be elastically deformed and adapted to clasp around an individual's neck.

11. The method of claim 10, wherein providing the wireless interface includes providing a housing adapted to be positioned behind the individual's neck.

12. The method of claim 11, wherein the housing include output connectors for optional wired communication with hearing aids.

13. The method of claim 8, wherein providing the wireless interface includes providing a lanyard which is adapted for routing around an individual's neck.

14. The method of claim 13, wherein providing the lanyard includes providing the lanyard adapted to position a housing behind the individual's neck.

15. The method of claim 14, wherein the housing include output connectors for optional wired communication with hearing aids.

16. The method of claim 1, wherein providing the wireless interface includes providing an over-voltage protection.

17. The method of claim 16, wherein providing over-voltage protection includes:

providing a detector; and providing a line-protector connected to the detector, wherein the detector controls function of the line-protector.

18. The method of claim 17, wherein providing the detector includes providing the detector to control power at the output connector by controlling the line-protector.

19. The method of claim 17, wherein providing the detector includes providing the detector to control at least one power supply.

20. The method of claim 19, wherein providing the detector includes providing the detector to disable power to the wireless interface by controlling the at least one power supply.

* * * * *

UNITED STATES PATENT AND TRADEMARK OFFICE

CERTIFICATE OF CORRECTION

PATENT NO. : 7,929,723 B2
APPLICATION NO. : 12/553857
DATED : April 19, 2011
INVENTOR(S) : Lawrence T. Hagen et al.

It is certified that error appears in the above-identified patent and that said Letters Patent is hereby corrected as shown below:

On the Title Page, Item (74), in "Attorney, Agent, or Firm", in column 2, line 1, delete "Schwegmann," and insert -- Schwegman, --, therefor.

Signed and Sealed this
Twenty-fifth Day of November, 2014

Michelle K. Lee

Michelle K. Lee
*Deputy Director of the United States Patent and Trademark Office*